US012790097B2

(12) United States Patent
Whitworth et al.

(10) Patent No.: US 12,790,097 B2
(45) Date of Patent: Nov. 10, 2026

(54) INSULATING CONTAINER

(71) Applicant: RTIC OUTDOORS, LLC, Katy, TX (US)

(72) Inventors: Steve Whitworth, Katy, TX (US); David Findlay, Katy, TX (US)

(73) Assignee: RTIC OUTDOORS, LLC, Katy, TX (US)

( * ) Notice: Subject to any disclaimer, the term of this patent is extended or adjusted under 35 U.S.C. 154(b) by 0 days.

(21) Appl. No.: 18/780,213

(22) Filed: Jul. 22, 2024

(65) Prior Publication Data

US 2025/0178817 A1 Jun. 5, 2025

Related U.S. Application Data

(60) Provisional application No. 63/605,199, filed on Dec. 1, 2023.

(51) Int. Cl.
*B65D 81/38* (2006.01)

(52) U.S. Cl.
CPC ..... *B65D 81/3813* (2013.01)

(58) Field of Classification Search
CPC ..... B65D 81/3813; B65D 81/3818; B65D 81/3823; B65D 81/38
USPC ..... 206/541; 220/592.2, 592.25
See application file for complete search history.

(56) References Cited

U.S. PATENT DOCUMENTS 1,895,278 A 1/1933 Crawford
1,922,485 A 8/1933 McKee
2,954,891 A 10/1960 Imber
3,027,286 A 3/1962 Kurhan
3,106,313 A 10/1963 Kurhan
(Continued)

FOREIGN PATENT DOCUMENTS

CA 2243820 C 5/2004
CA 2291299 C 9/2008
(Continued)

OTHER PUBLICATIONS

Amazon, Yapaspt, Wine Carrier Tote Bag Insulated 6 Bottle Travel Cooler Picnic with Expandable Zipper—Perfect for Wine Lover's Christmas Wedding Gift, Retrieved from https://www.amazon.com/Carrier-Insulated-Bottle-Travel-Expandable/dp/B08FC6DCQ4, Accessed on Sep. 17, 2021, 5 pages.
(Continued)

*Primary Examiner* — Jacob K Ackun
(74) *Attorney, Agent, or Firm* — QUARLES & BRADY LLP

(57) ABSTRACT

Disclosed herein are systems and methods for a container having a base that includes an outer base layer, an inner base layer, and a base insulation layer, the inner base layer defining an interior volume of the container. A moveable lid is coupled to the base at a first end thereof, the moveable lid including an outer lid layer, a first insulation layer, a second insulation layer, and an inner lid layer covering the first and second insulation layers. A seat is formed by the inner base layer, and the first insulation layer and the inner lid layer define a rim that contacts the seat when the moveable lid is in a closed position. The second insulation layer and the inner lid layer define a plug that forms an interference fit with the inner base layer to seal the interior volume when the moveable lid is in the closed position.

20 Claims, 12 Drawing Sheets

(56) References Cited

U.S. PATENT DOCUMENTS

D351,533 S 10/1994 Lynam, Jr.
D355,568 S 2/1995 Paulin et al.
D382,446 S 8/1997 Bacon
5,699,925 A 12/1997 Petruzzi
5,772,066 A 6/1998 Reynolds
5,890,809 A 4/1999 Nelson
6,439,389 B1 8/2002 Mogil
6,742,636 B2 6/2004 Godshaw
6,799,693 B2 10/2004 Meza
6,925,834 B2 8/2005 Fuchs
7,137,493 B2 11/2006 Siwak
7,357,271 B2 * 4/2008 Hase ..... B65D 81/3818 220/592.2
7,467,695 B2 12/2008 Gormick et al.
7,730,739 B2 6/2010 Fuchs
8,061,159 B2 11/2011 Mogil et al.
8,640,937 B2 2/2014 Pruchnicki
8,646,970 B2 2/2014 Mogil
8,870,045 B1 10/2014 Aguirre
8,899,071 B2 12/2014 Mogil et al.
9,139,352 B2 9/2015 Seiders et al.
D773,238 S 12/2016 Matthews et al.
D798,670 S 10/2017 Seiders et al.
D799,276 S 10/2017 Seiders et al.
D799,277 S 10/2017 Seiders et al.
9,775,428 B2 10/2017 Johnson
9,796,517 B2 10/2017 Seiders et al.
D809,869 S 2/2018 Seiders et al.
9,902,548 B2 2/2018 Seiders et al.
10,029,842 B2 7/2018 Seiders et al.
D833,831 S 11/2018 Triska et al.
10,138,048 B2 11/2018 Mitchell et al.
10,143,282 B2 12/2018 Seiders et al.
10,154,715 B2 12/2018 Wang
D836,997 S 1/2019 Jacobsen
D836,998 S 1/2019 Jacobsen
D839,682 S 2/2019 Jacobsen
D840,761 S 2/2019 Seiders et al.
D840,762 S 2/2019 Seiders et al.
D840,763 S 2/2019 Seiders et al.
D840,764 S 2/2019 Seiders et al.
D848,219 S 5/2019 Munie et al.
D848,220 S 5/2019 Munie et al.
D848,221 S 5/2019 Munie et al.
D848,222 S 5/2019 Munie et al.
D848,798 S 5/2019 Munie et al.
10,287,055 B2 5/2019 Barattin et al.
10,301,098 B2 5/2019 Luo
10,384,855 B2 8/2019 Seiders et al.
10,401,075 B2 9/2019 Bond
10,442,599 B2 10/2019 Seiders et al.
D867,823 S 11/2019 Jacobsen
10,486,882 B2 11/2019 Luo
D873,090 S 1/2020 Jacobsen
10,544,976 B2 1/2020 Triska et al.
10,556,725 B2 2/2020 Breyburg
10,577,167 B2 3/2020 Seiders et al.
D880,253 S 4/2020 Jacobsen
D880,254 S 4/2020 Jacobsen
D881,655 S 4/2020 Jacobsen
D886,537 S 6/2020 Jacobsen
D886,538 S 6/2020 Jacobsen
D886,539 S 6/2020 Jacobsen
10,730,684 B2 8/2020 Mitchell et al.
D894,692 S 9/2020 Herold
10,781,028 B2 9/2020 Munie et al.
D899,865 S 10/2020 Shi
D902,664 S 11/2020 Munie et al.
D904,830 S 12/2020 Meda et al.
10,954,055 B2 3/2021 Rogers et al.
10,981,716 B2 4/2021 Seiders et al.
D918,665 S 5/2021 Munie et al.
D918,666 S 5/2021 Munie et al.
10,994,917 B2 5/2021 Seiders et al.
10,994,918 B1 5/2021 Seiders et al.
D920,744 S 6/2021 Eisenhardt et al.
D921,440 S 6/2021 Munie et al.
D922,149 S 6/2021 Munie et al.
D922,150 S 6/2021 Munie et al.
D922,151 S 6/2021 Munie et al.
D922,828 S 6/2021 Munie et al.
D923,424 S 6/2021 Rong
D926,532 S 8/2021 Munie et al.
D927,262 S 8/2021 Munie et al.
D929,192 S 8/2021 Rogers et al.
11,076,666 B2 8/2021 Sullivan et al.
11,117,732 B2 9/2021 Seiders et al.
11,142,388 B2 10/2021 Dong
11,174,090 B2 11/2021 Rogers et al.
11,186,422 B2 11/2021 Seiders et al.
11,229,268 B2 1/2022 Munie et al.
D942,814 S 2/2022 Yao
D949,632 S 4/2022 Zhu et al.
D955,824 S 6/2022 Seiders et al.
D959,920 S 8/2022 Nassanian
D959,921 S 8/2022 Nassanian
D959,922 S 8/2022 Nassanian
11,401,101 B2 8/2022 Seiders et al.
11,407,579 B2 8/2022 Munie et al.
D966,824 S 10/2022 Yagi
11,465,823 B2 10/2022 Seiders et al.
D970,298 S 11/2022 Rogers et al.
D970,299 S 11/2022 Munie et al.
D972,372 S 12/2022 Munie et al.
D974,121 S 1/2023 Agbato
D975,501 S 1/2023 Seiders et al.
D975,991 S 1/2023 Simon et al.
D984,220 S 4/2023 Leyden et al.
D985,336 S 5/2023 Yan
11,661,262 B2 5/2023 Kuhn et al.
D990,229 S 6/2023 Fu et al.
11,685,589 B2 6/2023 Munie et al.
11,730,244 B2 8/2023 Sullivan et al.
D997,650 S 9/2023 Bullock et al.
11,767,157 B2 9/2023 Seiders et al.
D1,006,548 S 12/2023 Munie et al.
D1,014,085 S 2/2024 Rabiah
D1,020,815 S 4/2024 Leyden et al.
D1,020,816 S 4/2024 Leyden et al.
2002/0130131 A1 9/2002 Zucker et al.
2002/0190070 A1 12/2002 Panetta et al.
2003/0042091 A1 3/2003 Oh
2003/0102317 A1 6/2003 Gordon
2004/0035143 A1 2/2004 Mogil
2005/0103044 A1 5/2005 Mogil et al.
2005/0224501 A1 10/2005 Folkert et al.
2006/0144844 A1 7/2006 Kita
2008/0164265 A1 7/2008 Conforti
2009/0301511 A1 12/2009 Vinci
2010/0059199 A1 3/2010 Court
2010/0078441 A1 * 4/2010 Barnett ..... A45C 13/36 220/592.2
2010/0254634 A1 10/2010 Liu
2011/0167863 A1 7/2011 Herrbold
2012/0018465 A1 1/2012 Andrews
2012/0318808 A1 12/2012 McCormick
2013/0062356 A1 3/2013 Deka
2013/0182976 A1 7/2013 Ashley
2014/0226920 A1 8/2014 Passavia
2015/0136796 A1 * 5/2015 Muehlhauser ..... G09F 3/02 220/592.2
2018/0263346 A1 9/2018 Stephens
2019/0178565 A1 6/2019 Horton
2019/0202621 A1 7/2019 Rogers et al.
2021/0198028 A1 7/2021 Seiders et al.
2022/0000234 A1 1/2022 Lien
2022/0017287 A1 1/2022 Rogers et al.
2022/0073260 A1 3/2022 Seiders et al.
2022/0110426 A1 4/2022 Munie et al.
2022/0161986 A1 5/2022 Seiders et al.
2022/0408973 A1 12/2022 Pierre
2023/0028298 A1 1/2023 Seiders et al.
2023/0118288 A1 4/2023 Rogers et al.

(56) References Cited

U.S. PATENT DOCUMENTS

| | | | | |
|---|---|---|---|---|
| 2023/0125997 | A1* | 4/2023 | Poulsen | B65D 81/3813 206/541 |
| 2023/0141586 | A1* | 5/2023 | Kletzel | B65D 81/3823 206/545 |
| 2023/0264887 | A1 | 8/2023 | Munie et al. | |

FOREIGN PATENT DOCUMENTS

| | | | |
|---|---|---|---|
| CA | 2549327 | C | 4/2014 |
| EA | 0075585800002 | S | 1/2020 |
| EM | 0075585800002 | S | 1/2020 |
| WO | 02030233 | A1 | 4/2002 |
| WO | 03083387 | A1 | 10/2003 |
| WO | 2017088278 | A1 | 6/2017 |

OTHER PUBLICATIONS

Mad City Outdoor Gear, MaxPedition XBP Expandable Bottle Pouch, Retrieved from https://www.madcityoutdoor.com/collections/molle-hydration-pouches/products/maxpedition-xbp-expandable-bottle-pouch, Accessed on Sep. 17, 2021, 5 pages.

RTIC Outdoors LLC, Backpack Cooler, Retrieved from https://rticoutdoors.com/Backpack-Cooler, Accessed on Oct. 4, 2023, 16 pages.

RTIC Outdoors LLC, Everyday Cooler, Retrieved from https://rticoutdoors.com/Everyday-Cooler, Accessed on Oct. 4, 2023, 19 pages.

RTIC Outdoors LLC, Insulated Tote Bag, Retrieved from https://rticoutdoors.com/Insulated-Tote-Bag, Accessed on Oct. 4, 2023, 16 pages.

RTIC Outdoors LLC, Soft Pack Cooler, Retrieved from https://rticoutdoors.com/Soft-Pack-Cooler?size=30-Can&color=Patriot, Accessed on Oct. 4, 2023, 19 pages.

Youtube, Yeti Crossroads Backpack 23 Review, Durable Bag for Everyday Carry & Minimal Travel, Retrieved from https://www.youtube.com/watch?v=fEwtlUOqpbo&t=252s, Nov. 14, 2019, 2 pages.

Amazon, Yapaspt, Wine Carrier Tote Bag Insulated 6 Bottle Travel Cooler Picnic with Expandable Zipper—Perfect for Wine Lover's Christmas Wedding Gift, Retrieved from https://www.amazon.com/Carrier-Insulated-Bottle-Travel-Expandable/dp/B00FC6DCQ4, Accessed on Sep. 17, 2021, 5 pages.

Mad City Outdoor Gear, Mad Pedixition XBP Expandable Bottle Pouch, Retrieved from https://www.madcityoutdoor.com/collections/molle-hydration-pouches/products/maxpedition-xbp-expandable-bootle-pouch, Accessed on Sep. 17, 2021, 5 pages.

Rack to Door, QOMOTOP, 16 Cans Soft Sided Portable Cooler Bag with Leak-Proof Waterproof Zipper, Retrieved from https://racktodoor.com/products/16-cans-soft-sided-portable-cooler-bag-with-leak-proof-waterproof-zipper, Accessed on Sep. 21, 2023, 6 pages.

RTIC Outdoors LLC, Backpack Cooler, Retrieved from https://rticourtdoors.com/Backpack-Cooler, Accessed on Oct. 4, 2023, 16 pages.

RTIC Outdoor LLC, Everydoy Coolers, Retrieved from https://rticourtdoors.com/Everyday-Cooler, Accessed on Oct. 4, 2023, 19 pages.

RTIC Outdoors LLC, Insulated Tote Bag, Retrieved from https://rticourtdoors.com/Insulated-Tote-Bag, Accessed on Oct. 4, 2023, 16 pages.

RTIC Outdoors LLC, Soft Pack Cooler, Retrieved from https://rticourtdoors.com/Soft-Pack-Cooler?size=30-Can&color=Patriot, Accessed on Oct. 4, 2023, 19 pages.

YETI Coolers, LLC, Hopper Flip® 18 Soft Cooler, Retrieved from https://www.yeti.com/coolers/soft-coolers/hopper/flip/18050130002.html, Accessed on Oct. 13, 2023, 9 pages.

Youtube, Yeti Crossroads Backpack 23 Review, Durable Bag for Everyday Carry & Minimal Travel, Retrieved from https://www.youtube.com/watch?v=fEwtlU0qbo&t=242s, Nov. 14, 2019, 2 pages.

* cited by examiner

INSULATING CONTAINER

CROSS REFERENCE TO RELATED APPLICATIONS

This application claims the benefit of U.S. Provisional Application No. 63/605,199, filed on Dec. 1, 2023, which is incorporated by reference herein in its entirety.

BACKGROUND OF THE DISCLOSURE

1. Field of the Disclosure

The present disclosure relates to non-rigid and rigid portable containers and methods of manufacturing and use therefore, including a container with an insulating lid, which is also referred to as a cooler.

2. Description of the Background of the Disclosure

Coolers can be useful to transport, physically protect, and thermally insulate various items in solid and liquid form. For example, beverage containers, including aluminum cans or glass bottles for beer, seltzers, non-alcoholic beverages and the like, are often stored within a rigid or non-rigid portable cooler in large quantities and transported to a particular location for consumption. Fluid beverages are also often enjoyed at cold temperatures and, thus, it is desired for coolers to thermally insulate the fluid beverages during transport and/or during storage on-site. Further, coolers with waterproof closures are desired to prevent liquid from entering the cooler and coming into contact with contents sored therein. In particular, it is desired that coolers include multiple layers of waterproof protection to ensure that liquid does not enter the cooler while the cooler is closed.

SUMMARY

Various aspects are described in connection with illustrative implementation of a container disclosed herein.

In some aspects, a container includes a base that includes an outer base layer, an inner base layer, and a base insulation layer, the inner base layer defining an interior volume of the container. The container further includes a moveable lid coupled to the base at a first end thereof, the moveable lid including an outer lid layer, a first insulation layer, a second insulation layer, and an inner lid layer covering the first insulation layer and the second insulation layer. A seat is formed by the inner base layer at the first end of the base, and the first insulation layer and the inner lid layer define a rim that contacts the seat when the moveable lid is in a closed position. The second insulation layer and the inner lid layer define a plug that forms an interference fit with the inner base layer to seal the interior volume when the moveable lid is in the closed position.

In some embodiments, the container further includes a waterproof closure extending around a periphery of the first end of the base. In some embodiments, the outer base layer and the inner base layer are coupled to a first half of the waterproof closure, and the outer lid layer and the inner lid layer are coupled to a second half of the waterproof closure. In some embodiments, the outer base layer is made of polyester fabric. In some embodiments, the inner base layer extends atop the base insulation layer to define the seat, and the seat defines a planar surface. In some embodiments, the plug extends past the seat to abut the interior volume when the moveable lid is in the closed position. In some embodiments, the plug defines a first plug surface that abuts the interior volume when the moveable lid is in the closed position, and the plug further defines a second plug surface the periphery thereof. In some embodiments, the second plug surface is configured to contact sides of the inner base layer when the moveable lid is in the closed position.

According to another aspect of the disclosure, a container includes a base that includes an outer base layer, an inner base layer, and a base insulation layer. The container further includes a moveable lid that is coupled to the base at a first end thereof, the moveable lid including a cover, a plug, and an inner lid layer covering the cover and the plug. A y-axis extends in a direction that is parallel to the outer base layer. The plug protrudes from the cover, and the cover defines a first height measured along the y-axis that is greater than a second height of the plug measured along the y-axis.

In some embodiments, the second height of the plug is between about 25% and about 75% of the first height of the cover. In some embodiments, the cover defines a first depth measured perpendicular to the y-axis that is greater than a second depth of the plug measured perpendicular to the y-axis. In some embodiments, the second depth of the plug is between about 50% and 100% of the first depth of the cover. In some embodiments, the container further comprises one or more straps coupled to one or more patches that are coupled to the outer base layer. In some embodiments, the one or more patches are covered by flaps formed in the outer base layer. In some embodiments, the plug forms an interference fit with the inner base layer to seal an interior volume of the container defined by the inner base layer when the moveable lid is in the closed position.

According to another aspect of the disclosure, a method of manufacturing a container includes providing a shell, a liner, a closure, and one or more insulation layers. The method further includes forming a base and a lid with the shell to define a cavity, positioning the one or more insulation layers within the cavity, and positioning the liner within the cavity to cover the one or more insulation layers. The method further includes coupling the shell and the liner to a first half of the closure at a first end of the base, coupling a first strip of material to a second half of the closure and a top wall of the lid along a first outer periphery thereof, and coupling the liner to the second half of the closure.

In some embodiments, the shell includes an outer base layer and an outer lid layer, and the liner includes an inner base layer and an inner lid layer. In some embodiments, the inner lid layer is coupled to an underside of the lid to cover a first insulation layer and a second insulation layer. In some embodiments, positioning the liner within the cavity includes forming a seat with the liner atop a base insulation layer at the first end of the base. In some embodiments, the method further includes molding at least one of the top wall and a bottom wall of the container to include a logo thereon.

Various alternative implementations of the foregoing aspects are disclosed. The foregoing various aspects may be combined in any manner without limitation. The foregoing and other aspects and advantages of the disclosure will appear from the following description. In the description, reference is made to the accompanying drawings, which form a part hereof, and in which there is shown by way of illustration a preferred configuration of the disclosure. Such configuration does not necessarily represent the full scope of the disclosure, however, and reference is made therefore to the claims herein for interpreting the scope of the disclosure.

BRIEF DESCRIPTION OF THE DRAWINGS

The present disclosure will be better understood and features, aspects, and advantages other than those set forth above will become apparent when consideration is given to the following detailed description thereof. Such detailed description makes reference to the following drawings.

Figure 1:
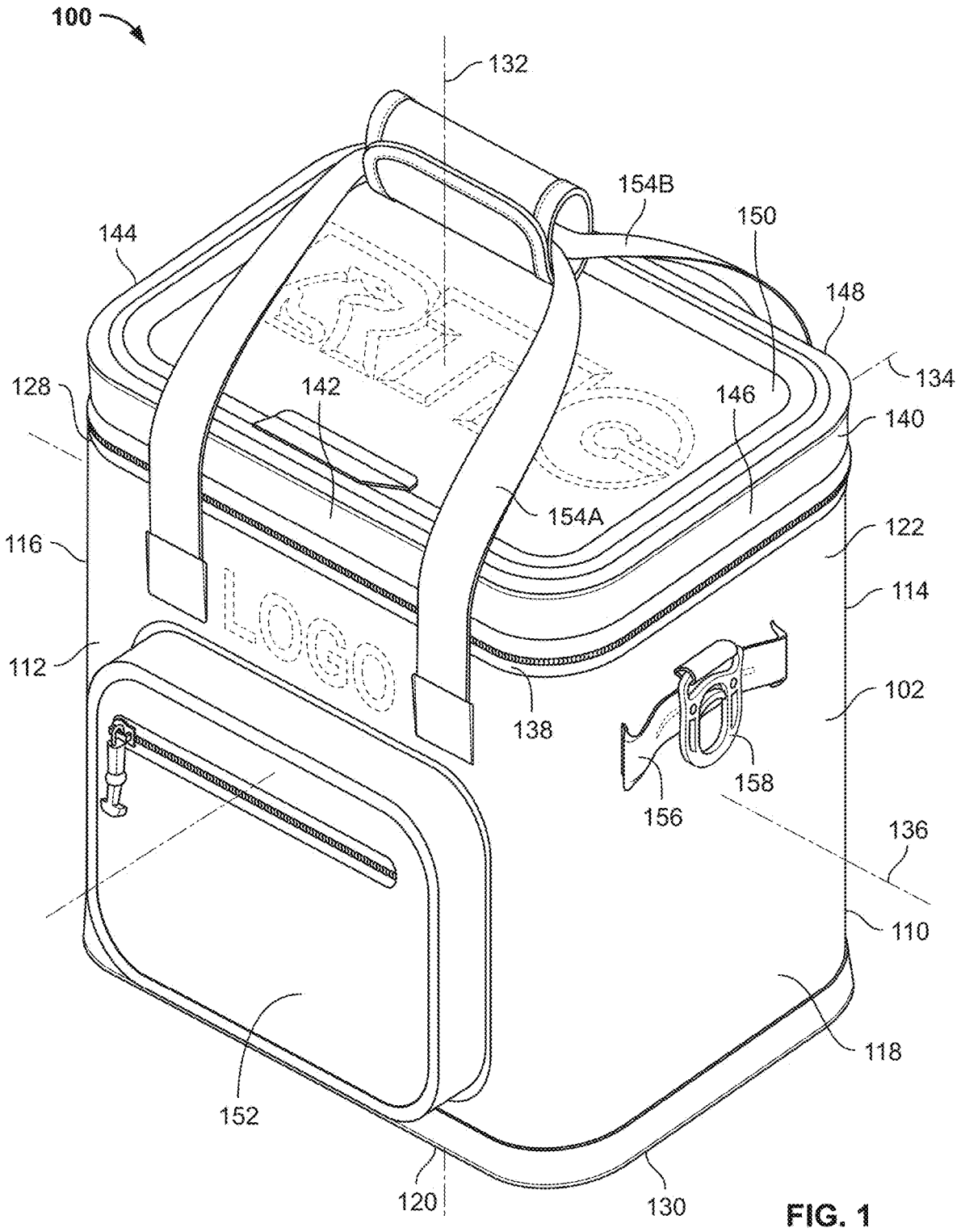
FIG. 1 is a front, top, and right side isometric view of a container in a closed position, according to an embodiment of the present disclosure.

Before the embodiments of the disclosure are explained in detail, it is to be understood that the disclosure is not limited in its application to the details of construction and the arrangement of the components set forth in the following description or illustrated in the drawings. Aspects of the disclosure are capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE DRAWINGS

The features, aspects and advantages are described below with reference to the drawings, which are intended to illustrate but not to limit the present disclosure. While the systems disclosed herein may be embodied in many different forms, several specific embodiments are discussed herein with the understanding that the embodiments described in the present disclosure are to be considered only exemplifications of the principles described herein, and the disclosure is not intended to be limited to the embodiments illustrated. Throughout the disclosure, the terms "about" and "approximate" mean plus or minus 5% of the number or value that each term precedes. In the drawings, like reference characters denote corresponding features consistently throughout the drawings. Also, while the terms "front side," "back side," "top," "base," "bottom," "side," "forward," and "rearward" and the like may be used in this specification to describe various example features and elements, these terms are used herein as a matter of convenience, e.g., based on the example orientations shown in the figures and/or the orientations in typical use. Unless otherwise stated, nothing in this specification should be construed as requiring a specific three dimensional or spatial orientation of structures in order to fall within the scope of the claims.

In the description that follows, reference is made to one or more container structures. It is contemplated that any of the disclosed structures may be constructed from any polymer, composite, plastic, injection molded plastic, and/or metal/alloy material, without departing from the scope of the disclosure. Additionally, it is contemplated that any manufacturing methodology may be utilized, without departing from the scope of the disclosure. For example, one or more of welding, e.g., high frequency, ultrasonic welding, or laser welding of fabric, or metal/alloy welding, gluing, stitching, molding, injection molding, blow molding, stamping, deep-drawing, casting, die-casting, rotational molding, or additive manufacturing processes may be used, as well as various finishing processes, including drilling, deburring, grinding, polishing, sanding, or etching processes, among many others, may be utilized to construct the various container structures, or portions thereof, described throughout the disclosure.

FIGS. 1-6 illustrate various aspects of an implementation of a container 100, which may be configured as an insulating container, a cooler, or an insulative enclosure, according to aspects of the present disclosure. In some applications, the container 100 is configured for transport, protection, and thermal insulation of one or more beverage containers, food items, and/or a free fluid (not shown). It should be understood, however, that the teachings herein are not limited to any particular beverage container, and are applicable to enclosures for containers of other products, including solids and liquids of various forms, temperatures, and compositions according to aspects of the present disclosure. In some examples, the container 100 comprises an outer portion or shell 102 and an inner portion or liner 104 (see FIG. 7) that is configured to fit within a cavity 108 (see FIG. 6) defined by the shell 102. The shell 102 includes a base 110 defining a front wall 112, a rear wall 114, a left wall 116, and a right wall 118, each of which extend upwardly from a bottom wall 120 to form a perimeter of the base 110.

In some aspects, each of the front, rear, left, right and bottom walls 112, 114, 116, 118, 120 of the base 110 are substantially planar walls that meet one another at curved corners of the base 110. The base 110 of the container is configured as a base assembly that includes an outer base layer 122 defined by the shell 102, an inner base layer 124 defined by the liner 104 (see FIG. 7), and a base insulation layer 126, which are best shown and described in relation to FIG. 9. Referring again to FIGS. 1-6, the base 110 has a top or first end 128 and a bottom or second end 130 that is opposite the first end 128. In some aspects, the container 100 defines a y-axis 132 that extends between the first end 128 and the second end 130, i.e., in a direction that is parallel to the outer base layer 122, a z-axis 134 that extends between the front wall 112 and the rear wall 114 in a direction that is perpendicular to the y-axis 132, and an x-axis 136 that extends between the left wall 116 and the right wall 118 in a direction that is perpendicular to the y-axis 132 and the z-axis 134. It is contemplated that the y-axis 132, the z-axis 134, and the x-axis 136 define corresponding planes of the container 100. For example, a YZ plane (not shown) extends along the y-axis 132 and the z-axis 134, a YX plane (not shown) extends along the y-axis 132 and the x-axis 136, and a ZX plane (not shown) extends along the z-axis 134 and the x-axis 136.

Referring specifically to FIG. 1, there is a first closure 138 at the first end 128 of the base 110 that extends along the periphery of the top of the front, left, and right walls 112, 116, 118 of the base 110, and at least partially along the periphery of the top of the rear wall 114 of the base 110. In particular, the first closure 138 is integral with the structure of the base 110 and serves as a connection point between the base 110 and a moveable lid 140. For example, the first closure 138 may be a zipper, rail-type closures, hook and loop fasteners, tabs, interference fitting closures, interlocking closures, magnetic closures, and/or any other suitable type of fastener, without departing from the scope of the present disclosure. In some examples, the first closure 138 is a waterproof closure that is configured to prevent liquid from entering the cavity 108 (see FIG. 7) when the lid 140 is arranged in a closed position and the first closure 138 is sealed. For example, the first closure 138 may be watertight up to about 5 pounds per square inch (psi) of atmospheric pressure, or up to about 9 psi of atmospheric pressure, or up to about 15 psi of atmospheric pressure, or at atmospheric pressures greater than about 1 psi.

In some aspects, the lid 140 is configured as a lid assembly and includes a front wall 142 a rear wall 144, a left wall 146, and a right wall 148, each of which extend downwardly from a top wall 150. In some aspects, each of the front, rear, left, right and top walls 142, 144, 146, 148, 150 of the lid 140 are substantially planar walls that meet one another at curved corners. The lid 140 is movably coupled to the base 110, such that when the lid 140 is in a closed position, i.e., when the lid 140 is secured to the base 110 via the first closure 138, each of the walls 112, 114, 116, 118 of the base 110 are flush with the corresponding walls 142, 144, 146, 148 of the lid 140, respectively. Put another way, when the lid 140 is in a closed position as illustrated in FIGS. 1-6, the front wall 112 of the base 110 and the front wall 142 of the lid 140 at least partially define a shared plane, the rear wall 114 of the base 110 and the rear wall 144 of the lid 140 at least partially define a shared plane, the left wall 116 of the base 110 and the left wall 146 of the lid 140 at least partially define a shared plane, and the right wall 118 of the base 110 and the right wall 148 of the lid 140 at least partially define a shared plane. In some embodiments, the walls 142, 144, 146, 148 of the lid 140 are not flush with the corresponding walls 112, 114, 116, 118 of the base 110. For example, the lid 140 can define a larger perimeter than the base, and/or the lid 140 can define a tapered profile in a vertical direction, e.g., along the y-axis 132. In some examples, the container 100 further includes a front pocket 152, straps 154, side handles 156, and/or attachment rings 158, as will be discussed in greater detail below.

Figure 2:
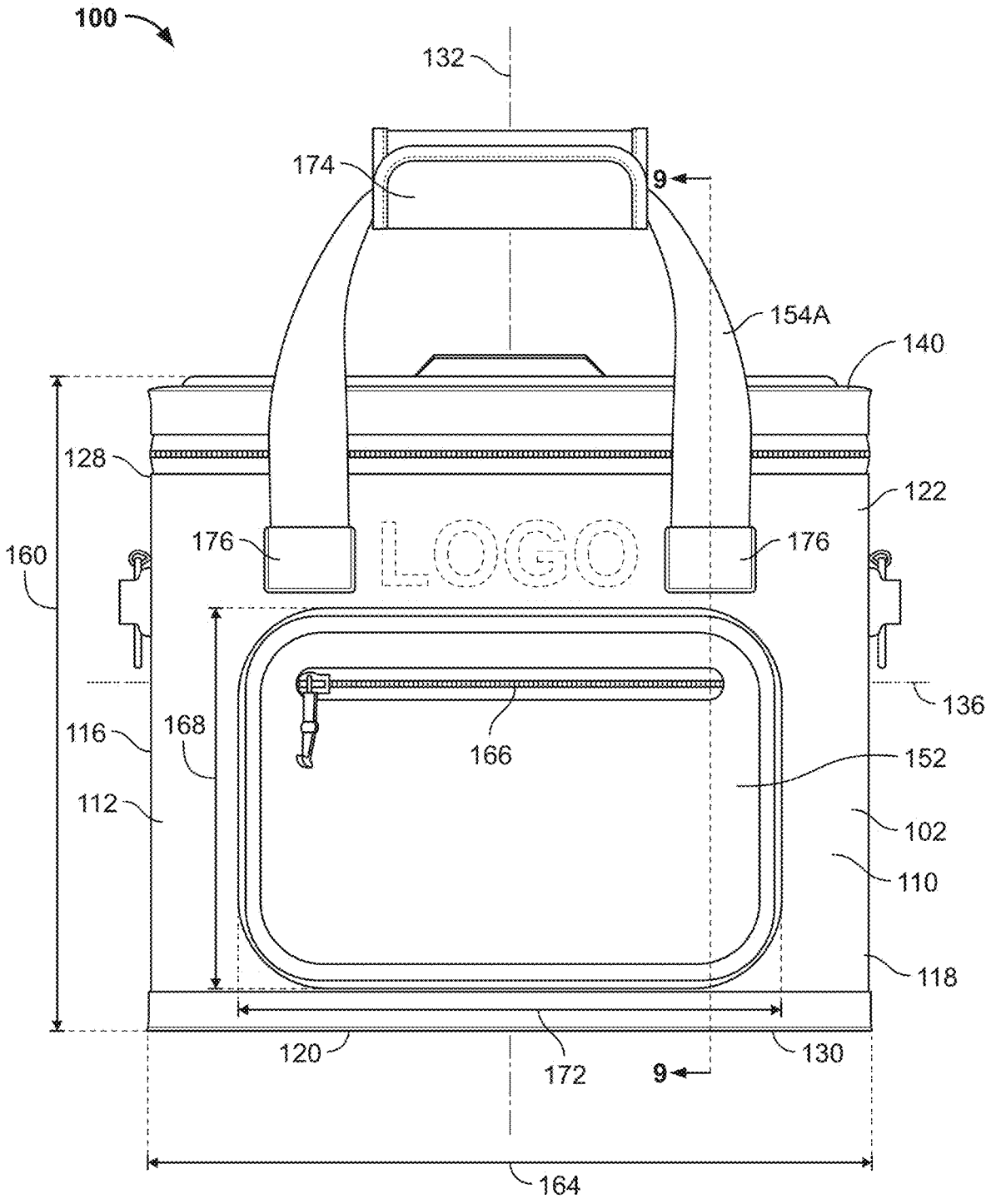
FIG. 2 is a front elevational view of the container of FIG. 1.
Figure 3:
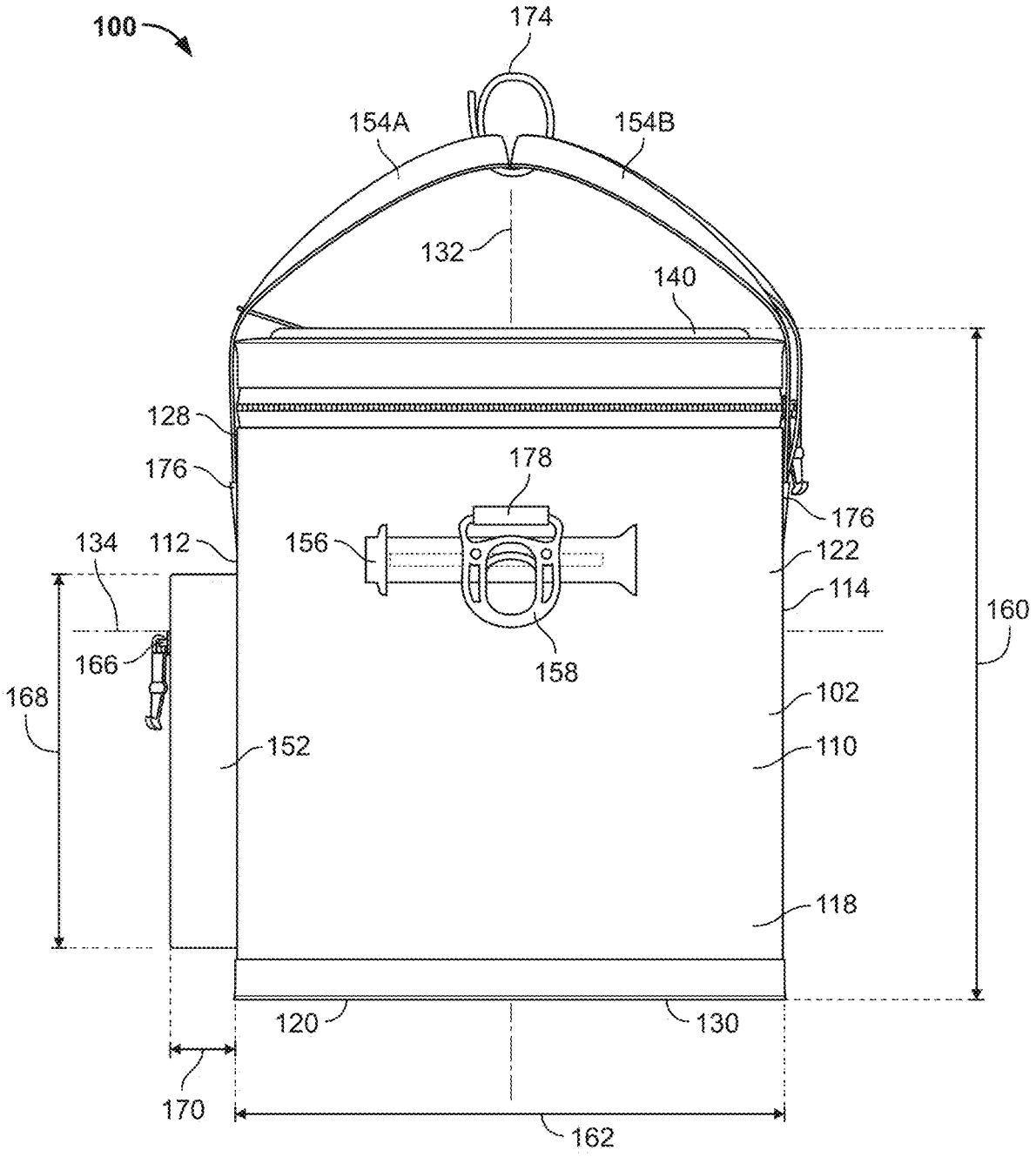
FIG. 3 is a right-side elevational view of the container of FIG. 1.

Referring specifically to FIGS. 2 and 3, front and side elevational views, respectively, are illustrated of the container 100. It is contemplated that aspects relating to the right wall 118 of the base 110 as described herein are also applicable to the left wall 116 of the base 110. Various dimensions of the container 100 are shown, including an external height 160 of the container 100, an external depth 162 of the container 100, and an external height 164 of the container 100. Each of the external height, depth, and width 160, 162, 164 of the container 100 are measured along the y-axis 132, the z-axis 134, and the x-axis 136 respectively. As such, it will be appreciated that a height may be measured in a direction that is parallel with respect to the y-axis 132, a depth may be measured in a direction that is parallel with respect to the z-axis 134, and a width may be measured in a direction that is parallel with respect to the x-axis 136. In the illustrated embodiment, the external height 160 is illustrated as a maximum height of the container 100 in a closed position, the external depth 162 is illustrated as a maximum depth of the container 100 in a closed position, and the external width 164 is illustrated as a maximum width of the container 100 in a closed position.

In some aspects, the external height 160 of the container 100 may be between about 50% and about 150% of the external width 164, or between about 50% and about 100% of the external width 164, or between about 75% and about 100% of the external width 164, or between about 80% and about 90% of the external width 164, or about 85% of the external width 164 of the container 100. In some aspects, the external depth 162 of the container 100 may be between about 50% and about 150% of the external height 160, or between about 50% and about 100% of the external height 160, or between about 75% and about 100% of the external height 160, or between about 75% and about 85% of the external height 160, or, about 80% of the external height 160 of the container 100.

Still referring to FIGS. 2 and 3, the container 100 further includes a pocket 152, e.g., a front pocket, on the front wall 112 of the base 110. It is contemplated that the pocket 152 may be formed in the shell 102 so as to be flush with front wall 112 of the base 110, or the pocket 152 can be formed as an external pocket on the front wall 112. In some aspects, the container 100 includes additional pockets (not shown) located on one or more of the walls 112, 114, 116, 118 of the base 110. In the illustrated non-limiting example illustrated in FIGS. 2 and 3, the pocket 152 is a substantially rectangular, external pocket that protrudes outward from the front wall 112 of the base 110, e.g., in a direction along the z-axis 134 (see FIG. 1).

In some aspects, the pocket 152 is integrally formed with the front wall 112 of the base 110, or the pocket 152 is coupled to the front wall 112 of the base 110 via stitching, glue, welding, and/or another suitable fastening technique. The pocket 152 is configured to hold a variety of objects, such as, e.g., cell phones, wallets, small purses, car keys, a beverage container, a beverage enclosure that contains a beverage container, and/or other objects sized and shaped accordingly. In addition, the pocket 152 has a second closure 166 extending at least partially therealong, e.g., in a direction that is parallel to the z-axis 134, and the second closure 166 is substantially similar to the first closure 138. For example, the second closure 166 may be a zipper, waterproof closure, rail-type closures, hook and loop fasteners, tabs, interference fitting closures, interlocking closures, magnetic closures, and/or any other suitable type of fastener, without departing from the scope of the present disclosure.

Various dimensions of the pocket 152 are shown in FIGS. 2 and 3, including a height 168 of the pocket 152 measured along the y-axis 132, a depth 170 of the pocket 152 measured along the z-axis 134, and a width 172 of the pocket 152 measured along the x-axis 136. In some aspects, the height 168 of the pocket 152 may be between about 25% and about 75% of the external height 160, or between about 50% and about 70% of the external height 160, or between about 50% and about 60% of the external height 160, or about 57% of the external height 160 of the container 100. In some aspects, the depth 170 of the pocket 152 may be between about 5% and about 50% of the external depth 162, or between about 5% and about 25% of the external depth 162, or between about 5% and about 15% of the external depth 162, or about 10% of the external depth 162 of the container 100. In some aspects, the width 172 of the pocket 152 may be between about 50% and about 100% of the external width 164, or between about 60% and about 80% of the external width 164, or between about 70% and about 80% of the external width 164, or about 77% of the external width 164 of the container 100.

Referring specifically to FIG. 2, and as discussed above, the container 100 further includes straps 154, e.g., straps for carrying the container 100. For example, the container 100 includes a front or first strap 154A coupled to the front wall 112 of the container 100 and a rear or second strap 154B coupled to the rear wall 114 (see FIG. 4) of the container 100. It is contemplated that the straps 154 may be formed of webbing, such as, e.g., nylon webbing, or other materials that may include, among other, polypropylene, neoprene, polyester, Dyneema, Kevlar, cotton fabric, leather, plastics, rubber, or rope. In some aspects, each strap 154 has a thickness of between about 0.50 millimeters and about 2.0 millimeters, or between about 1.0 millimeters and about 1.5 millimeters, or about 1.3 mm. While FIGS. 1-6 illustrate the container 100 as including both the first strap 154A and the second strap 154B, it is contemplated that fewer or additional straps may be coupled to the containers 100. In some aspects, the straps 154 are configured to support less than about 100 pounds (45.4 kilograms), or less than about 150 pounds (68.0 kilograms), or less than about 200 pounds (90.7 kilograms), or less than about 250 pounds (113.4 kilograms).

Referring again to the non-limiting example illustrated in FIG. 2, the straps 154 are similarly sized and configured to be coupled at midpoints thereof by a handle flap 174. In some aspects, the handle flap 174 is carried by the front strap 154A or the rear strap 154B, and the handle flap 174 further comprises a fastener for coupling opposing ends of the handle flap 174 to each other. For example, the handle flap 174 is carried by the second strap 154B and is configured to have a pair of fasteners (not shown) comprising male portions (not shown) located on a first end of a first surface and female portions (not shown) located on a second end of the first surface, with the first end being opposite the second end. As such, when the midpoints of the first strap 154A and the second strap 154B are proximate each other (see FIG. 3), the second end of the handle flap 174 may be wrapped around a portion of the first strap 154A so that the male and female portions of the pair of fasteners (not shown) are coupled together, thereby securing the first and second straps 154A, 154B together.

In some examples, the straps 154 are coupled to the base 110, e.g., the front wall 112 and the rear wall 114 (see FIG. 4), via patches (not shown) that are attached to or formed integrally with the shell 102. Put another way, the straps 154 are attached, e.g., adhered, stitched, welded, and/or otherwise fastened, to patches (not shown) which in turn are coupled to the base 110. In some aspects, the patches (not shown) are coupled to the exterior of the shell 102 such that the patches (not shown) are visible, or the patches (not shown) are covered by, i.e., disposed beneath, the shell 102. For example, the patches (not shown) are covered by flaps 176 formed in the shell 102 so as to cover the attachment points of the straps 154 to the base 110.

Referring now to FIG. 3, the container 100 further includes side handles 156 and attachment rings 158, e.g., a component having an aperture extending therethrough, that are coupled to the sides, e.g., the left wall 116 (see FIG. 1) and the right wall 118 of the container 100. Specifically, the side handles 156 and the attachment rings 158 are located approximately centrally between the front wall 112 (see FIG. 1) and the rear wall 114 (see FIG. 4). Further, the side handles 156 and the attachment rings 158 are located closer to the lid 140 than the bottom wall 120 (see FIG. 6), although it will be understood that the side handles 156 and the attachment rings 158 can be coupled to the container 100 at any suitable position on the base 110.

In some aspects, the side handles 156 are coupled to the container 100 via patches (not shown) that are attached to or formed integrally with the shell 102. Put another way, the side handles 156 are attached, e.g., adhered, stitched, welded, and/or otherwise fastened, to patches (not shown) which in turn are coupled to the base 110. For example, both ends of one side handle 156 are attached to one or more patches (not shown) that are coupled to the base 110. In some aspects, the patches (not shown) are coupled to the exterior of the shell 102 such that the patches (not shown) are visible, or the patches (not shown) are covered by, i.e., disposed beneath, the shell 102. For example, the patches (not shown) may be covered by flaps 176 formed in the shell 102 so as to cover the attachment points of the straps 154 to the base 110. Further, it is contemplated that the side handles 156 may be formed of webbing, such as, e.g., nylon webbing, or other materials that may include, among other, polypropylene, neoprene, polyester, Dyneema, Kevlar, cotton fabric, leather, plastics, rubber, or rope.

In some aspects, the attachment rings 158 are configured to receive opposing ends of a shoulder strap (not shown). In particular, each attachment ring 158 is configured to receive a clasp located at each opposing end of the shoulder strap (not shown) such that the clasp can be removably hooked to each attachment ring 158 to selectively attach and remove the shoulder strap (not shown) from the container 100 as desired. In some examples, the attachment rings 158 are coupled to loops 178 of fabric which in turn are coupled to the shell 102. For example, a single loop 178 extends through an aperture in a single attachment ring 158 so as to couple the attachment ring 158 to the right wall 118 of the base 110. Correspondingly, the loops 178 are coupled, e.g., stitched, adhered, welded, to patches (not shown) that are covered by the shell 102 and/or coupled to an interior (not shown) of the shell 102. In some examples, one side handle 156 and one loop 178 are connected to a single patch (not shown) on each side wall 116, 118 of the container 100, although it is contemplated that multiple side handles 156, loops 178, and/or attachment rings 158 can be coupled to the base 110 at a variety of different locations.

It is contemplated that the attachment rings 158 may be constructed from one or more polymers, metals, ceramics, glasses, alloys, or combinations thereof. In some examples, the attachment rings 158 may be constructed from polypropylene, neoprene, polyester, Dyneema, Kevalar, cotton fabric, leather, plastics, rubber, and/or rope. Further, the attachment rings 158 each define a substantially D-shape, e.g., D-rings, but the attachment rings 158 may include other shapes such as, for example, round, square, rectangular, triangular, or multiple rings with multiple attachment points and apertures. Moreover, it is contemplated that the loops 178 may be formed of webbing, such as, e.g., nylon webbing, or other materials that may include, among other, polypropylene, neoprene, polyester, Dyneema, Kevlar, cotton fabric, leather, plastics, rubber, or rope.

Figure 4:
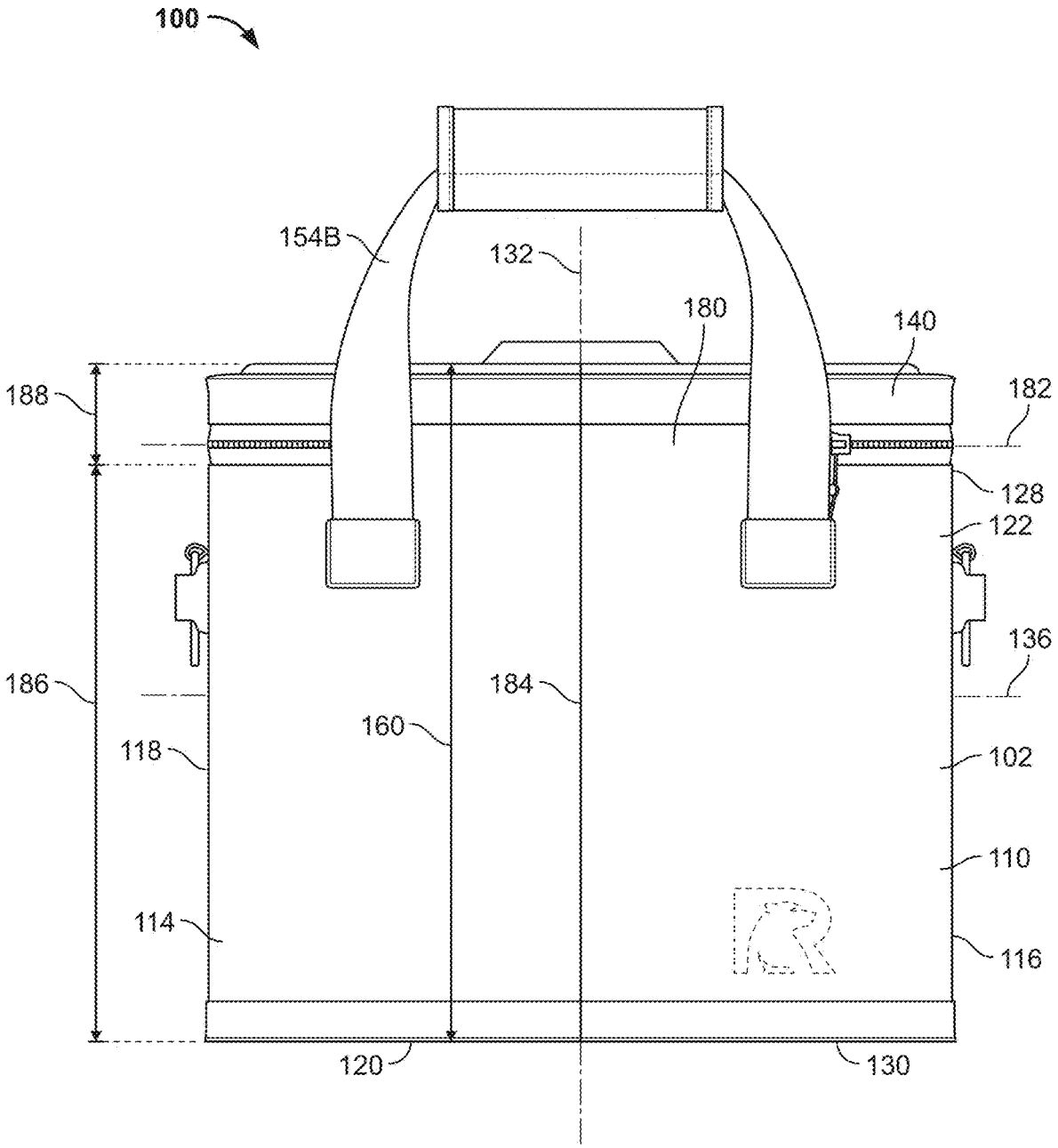
FIG. 4 is a rear elevational view of the container of FIG. 1.

Referring now to FIG. 4, the rear wall 114 of the base 110 and the rear wall 144 of the lid 140 define a hinge 180 of the container 100. Specifically, the hinge 180 couples the base 110 to the lid 140 and defines a hinge axis 182 that extends between an interface of the base 110 and the lid 140 in a direction that is parallel with the x-axis 136. In this way, the lid 140 can be rotated about the hinge axis 182 when, e.g., the lid 140 is opened or closed. In some aspects, the hinge 180 is formed by the shell 102 and the inner liner 104 (see FIG. 7), meaning that the hinge 180 serves as a connection point between the shell 102 and the liner 104 (see FIG. 7). In some examples, the hinge 180 is a living hinge, and the hinge 180 allows the lid 140 to be actuated between an open position (see FIG. 7) and a closed position as illustrated in FIGS. 1-6, and as will be discussed below in greater detail.

In some examples, the shell 102 is formed as an integral one-piece structure, or the shell 102 can be formed as a multiple component assembly. In the non-limiting example illustrated in FIG. 4, the shell 102 is an integral one-piece component with a seam 184 that extends vertically, e.g., in a direction that is parallel with the y-axis 132, along the rear walls 114, 144, of the base 110 and the lid 140, respectively. In some aspects, the seam 184 is formed by joining sides of the one-piece shell 102 together using a suitable fastening technique, e.g., adhering, stitching, and/or welding, to secure the shell 102 around the container 100. Correspondingly, it is contemplated that the shell 102 may be constructed from neoprene, polyester, cotton fabric, mesh fabric, leather, plastics, rubber, nylon, and/or molded EVA (Ethylene Vinyl Acetate). In some examples, the shell 102 is made of or constructed from a synthetic fabric, e.g., polyester and/or nylon fabric. Further, the shell may include an outer and/or double-sided coating using, e.g., fabric, nylon, felt, thermoplastic polyurethane, etc. In some aspects, the container 100, e.g., the shell 102 and the liner 104, can withstand about 25 pounds (111.2 Newtons) or less of puncture force, or about 50 pounds (222.4 Newtons) or less of puncture force, or about 75 pounds (333.6 Newtons) or less of puncture force, or about 100 pounds (444.8 Newtons) or less of puncture force, or about 125 pounds (556.0 Newtons) or less of puncture force, e.g., puncture force provided during a benchtop puncture test.

Still referring to the non-limiting example illustrated in FIG. 4, additional dimensions of the container 100 are shown, including a height 186 of the base 110 and a height 188 of the lid 140. Each of the base and lid heights 186, 188 are measured along the y-axis 132. In some aspects, the external height 160 is defined by the sum of the heights 186, 188 of the base 110 and the lid 140. In some aspects, the height 188 of the lid 140 may be between about 1% and about 25% of the height 186 of the base 110, or between about 5% and about 15% of the height 186 of the base 110, or between about 10% and about 15% of the height 186 of the base 110, or about 13% of the height 186 of the base 110.

Figure 5:
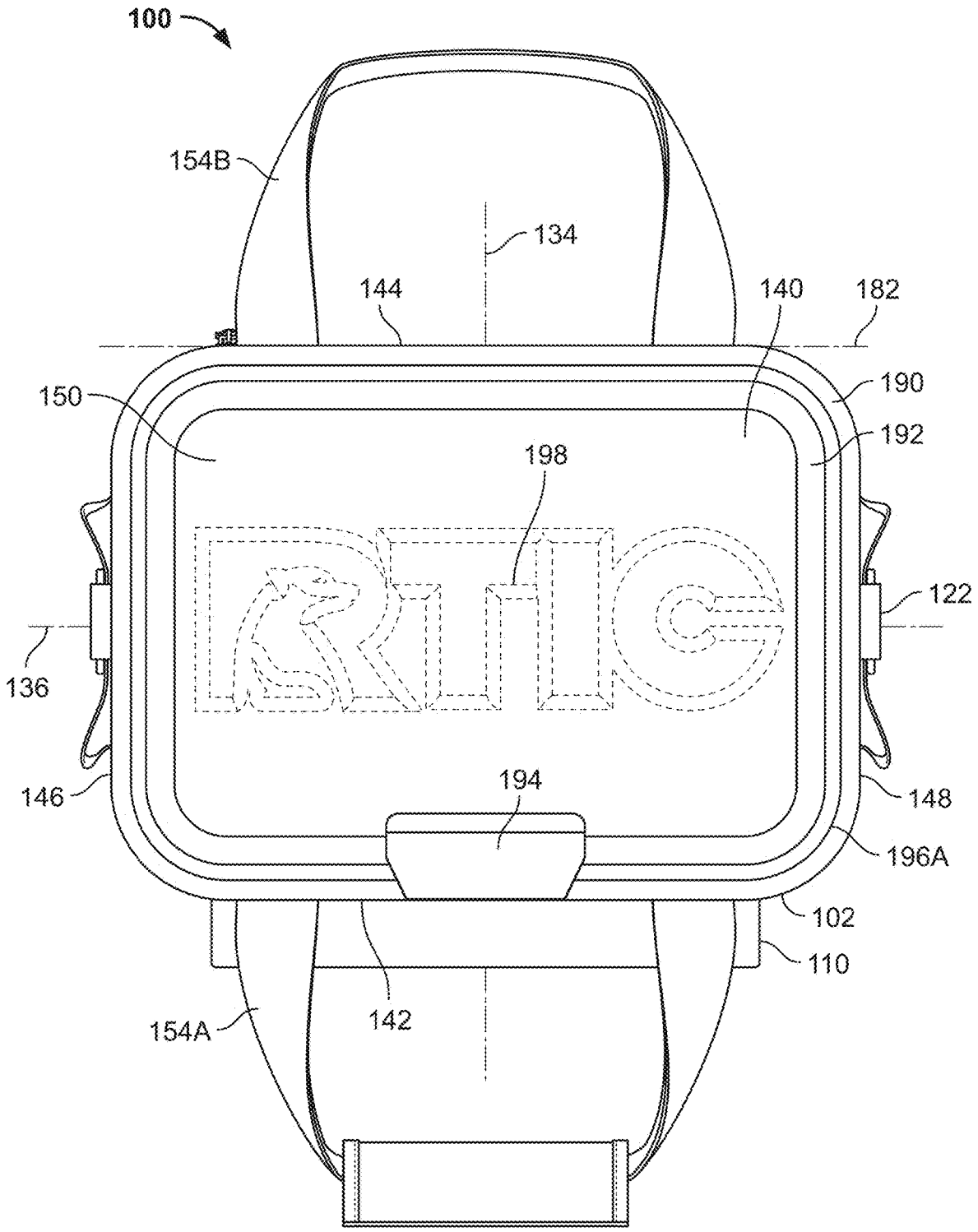
FIG. 5 is top plan view of the container of FIG. 1.

Referring now to FIG. 5, the top wall 150 of the lid 140 is substantially rectangular-shaped or square-shaped, although it is contemplated that the top wall 150 can be shaped differently than shown, e.g., circular, ovular, triangular, etc. In some examples, the lid 140 includes an upper or first strip 190 of material, an upper or first ridge 192, and a tab 194 that are each coupled to the top wall 150 of the lid 140. Specifically, the first strip 190 extends around the outer periphery of the lid 140 and is configured to protect and reinforce the lid 140. Put another way, the first strip 190 increases the rigidity of the lid 140. In some examples, the first strip 190 is configured as a corner support and/or joint, meaning that the first strip 190 wraps over the peripheral edge of the top wall 150 so as to couple the top wall 150 with each of the walls 142, 144, 146, 148 of the lid 140.

Figure 9:
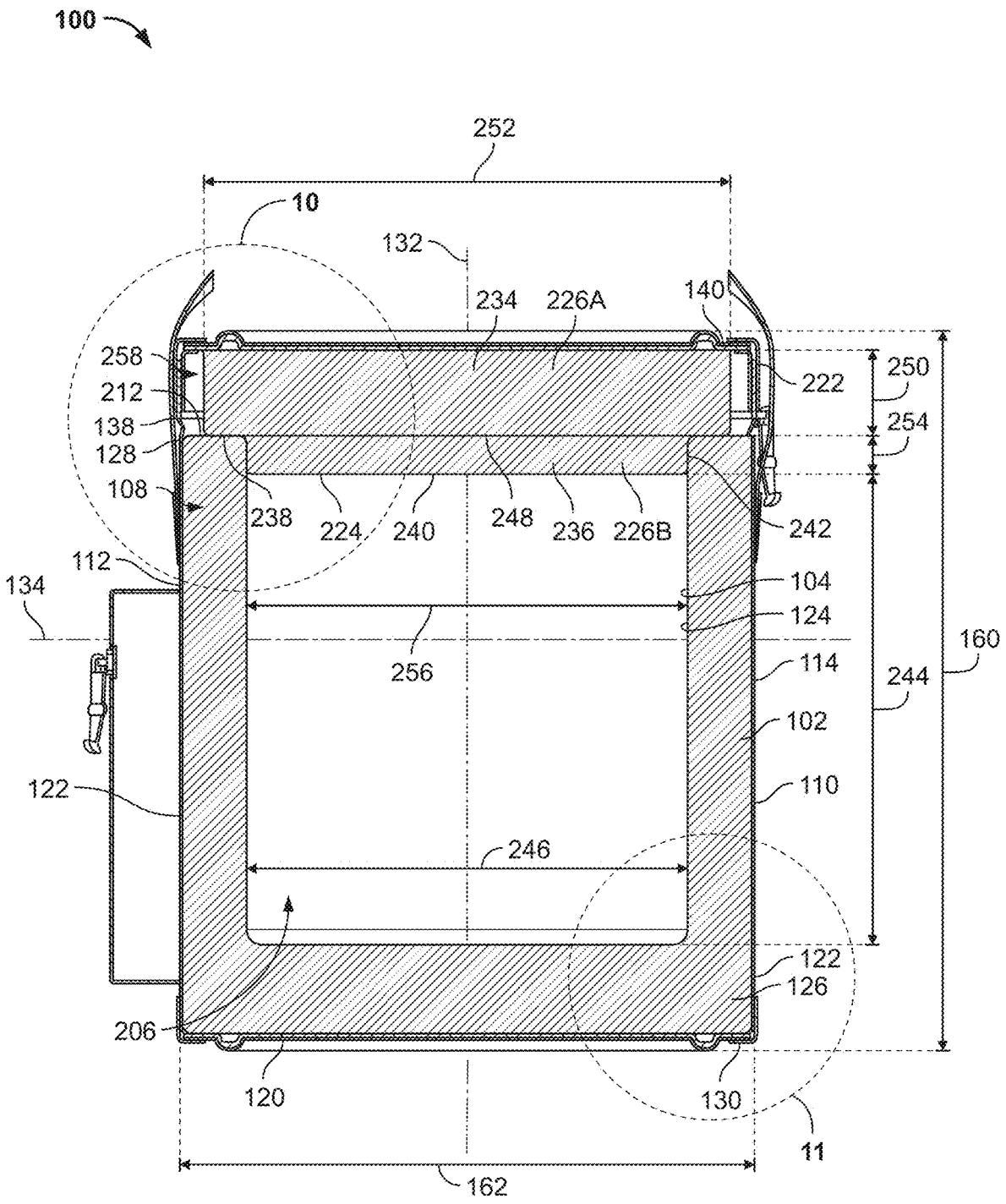
FIG. 9 is a cross-sectional view of the container of FIG. 7 taken through line 9-9 of FIG. 2.

In other examples, the first strip 190 defines each of the walls 142, 144, 146, 148 of the lid 140, and the first strip 190 forms an upper or first joint 196A (see FIG. 9) between top wall 150 and the first closure 138 (see FIG. 1), as is best shown and described in relation to FIG. 9. In some aspects, the first strip 190 is an integral one-piece structure, and the seam 184 formed along the rear wall 114 of the base 110 (see FIG. 4) extends into the first strip 190, meaning that sides of the first strip 190 are also joined together along the seam 184 (see FIG. 5) via, e.g., adhering, stitching, and/or welding. It is contemplated that similar fastening techniques may be used to couple the first strip 190 to the top wall 150. In some aspects, the first strip 190 is formed of a similar material as the shell 102, e.g., polyester fabric. In other examples, the first strip 190 is constructed of a more rigid material than the material of the shell 102.

Still referring to FIG. 5, the first ridge 192 also extends around the top wall 150 of the lid 140. In particular, the first ridge 192 is inset from the peripheral edge of the top wall 150, i.e., inset from the first strip 190. In some aspects, the first ridge 192 defines a curved or semi-circular profile as best shown and described in relation to FIG. 10, and the first ridge 192 extends upwardly, i.e., along the y-axis 132 (see FIG. 1), from the top wall 150. With continued reference to FIG. 5, the first ridge 192 is formed integrally with the top wall 150 of the lid 140. For example, the first ridge 192 can be formed during manufacture of the lid 140 using, e.g., injection molding, blow molding, stamping, die-casting, etc. In some aspects, a logo 198 is also formed in the top wall 150 during the manufacture thereof. For example, the logo 198 can be compression molded, injection molded, printed, stamped, cast, pressed, and/or embossed in the top wall 150 of the lid 140.

In some examples, the tab 194 is coupled to the top wall 150 of the lid 140. Specifically, the tab 194 is inset from the front wall 142 of the lid 140 and extends outward and upward therefrom, e.g., in a direction towards the front wall 142 and away from the top wall 150 of the lid 140. In some aspects, the tab 194 is positioned on the top wall 150 inward relative to the first ridge 192, and the tab 194 partially extends over the first ridge 192. Further, one end of the tab 194 is coupled to the lid 140 via, e.g., adhering, stitching, and/or welding. In some aspects, the tab 194 is a rectangular tab, although it is contemplated that a variety of different shapes could be used for the tab, e.g., trapezoidal, ovular, triangular, etc. To that end, the tab 194 is sized so a user can easily grasp the tab to selectively open and close the lid 140, i.e., to actuate the lid 140 about the hinge axis 182. Using the tab 194 is particularly advantageous when the lid 140 or a portion thereof extends partially into the cavity 108 (see FIG. 7) when the lid 140 is in the closed position, as will be discussed below in greater detail. In some aspects, the tab 194 is constructed of neoprene, polyester, cotton fabric, mesh fabric, leather, plastics, rubber, nylon, metal, and/or molded EVA (Ethylene Vinyl Acetate). In one example, the tab 194 is constructed of a polyester sheet that is coupled at one end to the top wall 150 of the lid 140 and then folded over onto itself before being further fastened to the top wall 150.

Figure 6:
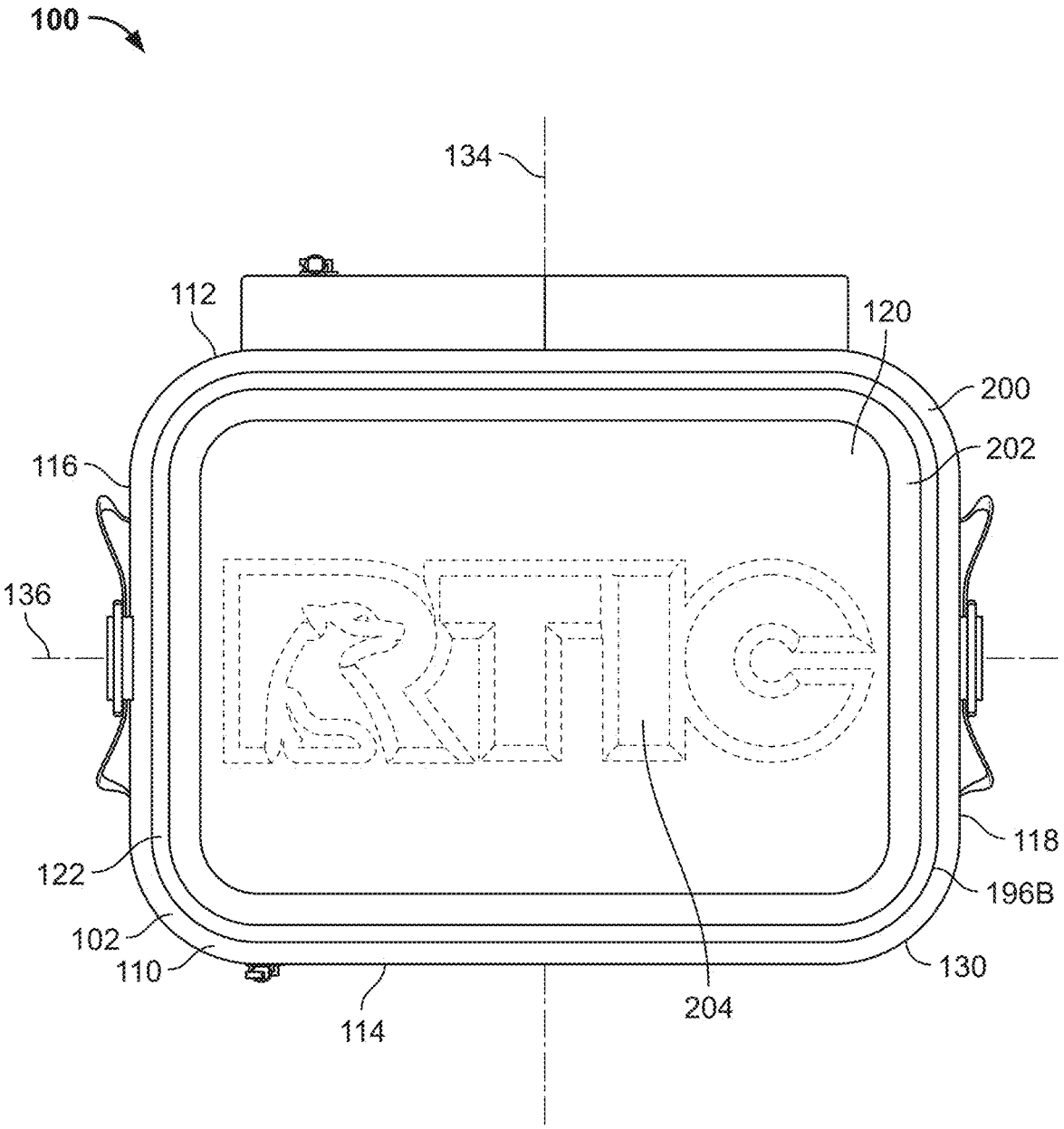
FIG. 6 is a bottom plan view of the container of FIG. 1.

Referring now to FIG. 6, a bottom plan view is illustrated of the container 100. In some aspects, the bottom wall 120 of the base 110 is substantially rectangular-shaped or square-shaped, although it is contemplated that the bottom wall 120 can be shaped differently than shown. In some aspects, the base 110 includes a lower or second strip 200 of material and a lower or second ridge 202 that are coupled to the bottom wall 120 of the base 110. For example, the second strip 200 may mirror the first strip 190 (see FIG. 5), meaning that the second strip 200 extends around the outer periphery of the bottom wall 120 and is configured to protect and reinforce the base 110. In some aspects, the second strip 200 is configured as a corner support and/or forms a lower or second joint 196B (see FIG. 11) between the bottom wall 120 and the front, rear, left, and right walls 112, 114, 116, 118 of the base 110. Further, the second strip 200 is an integral one-piece structure. In some examples, the seam 184 formed along the rear wall 114 (see FIG. 4) of the base 110 extends into the second strip 200, meaning that sides of the second strip 200 are also joined together along the seam 184 (see FIG. 4) via, e.g., adhering, stitching, and/or welding. Correspondingly, the second strip 200 is coupled to the bottom wall 120 using a suitable fastening technique, e.g., adhering, stitching, and/or welding. In some aspects, the second strip 200 is formed of a similar material as the shell 102, e.g., polyester fabric, or a different material, e.g., rubber.

Still referring to FIG. 6, the second ridge 202 may mirror the first ridge 192 (see FIG. 5), meaning that the second ridge 202 extends around the bottom wall 120 of the base 110 and defines a curved or semi-circular profile that extends downwardly, i.e., along the y-axis 132 (see FIG. 1), from the bottom wall 120. Correspondingly, the second ridge 202 elevates the container 100 above the ground or another surface when the container 100 is placed upright. This in turn prevents the bottom wall 120 from directly contacting the ground, which can reduce wear on the bottom wall 120. In some examples, the second ridge 202 is inset from the peripheral edge of the bottom wall 120, i.e., inset from the second strip 200. Moreover, the second ridge 202 is formed integrally with the bottom wall 120 of the base 110. For example, the second ridge 202 can be formed during manufacture of the base 110 using, e.g., injection molding, blow molding, stamping, die-casting, etc. In some aspects, a logo 204 is also be formed in the bottom wall 120 during the manufacture thereof. For example, the logo 204 can be molded or directly embossed into the bottom wall 120 of the base 110.

Figure 7:
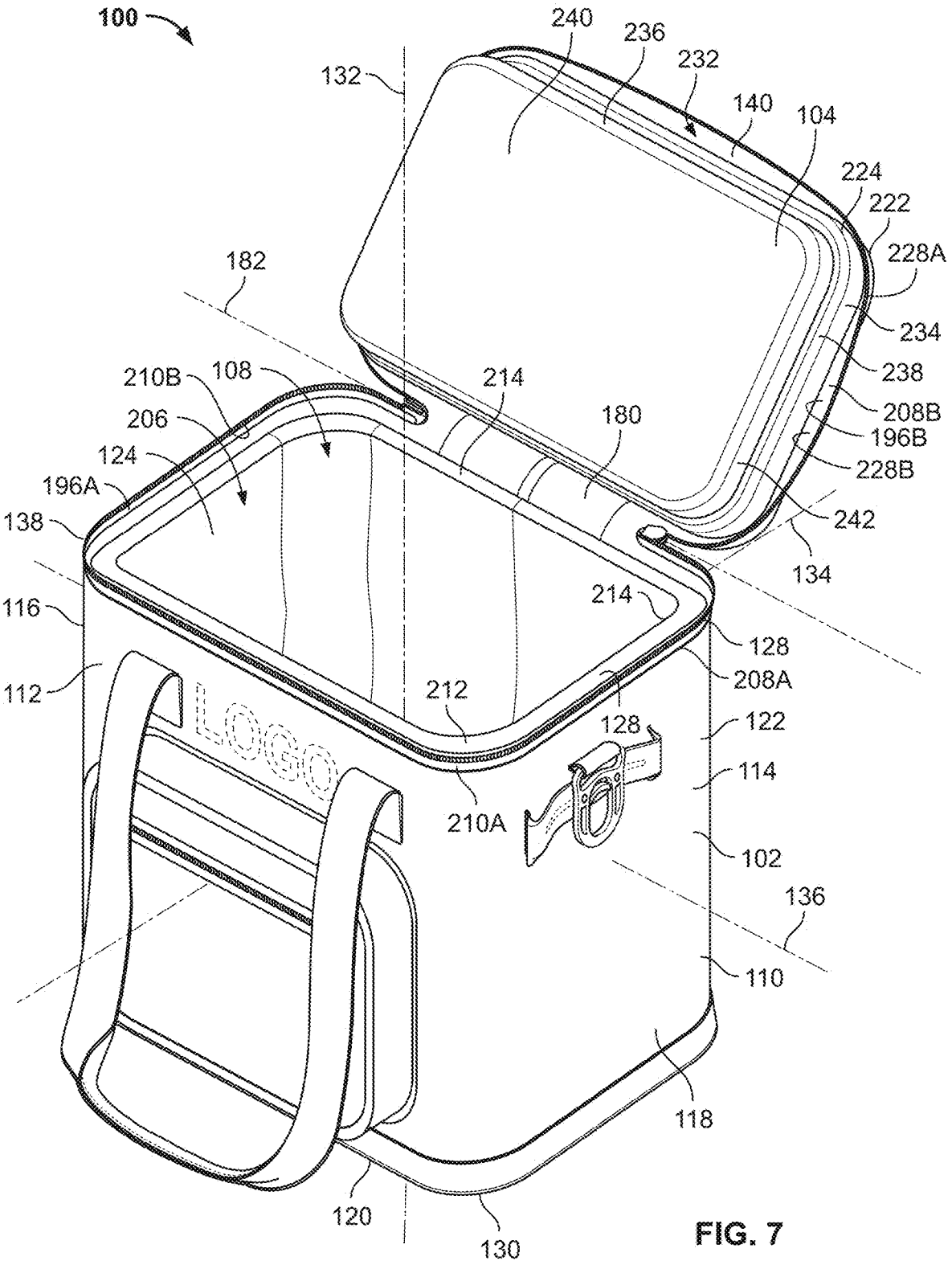
FIG. 7 is a front, top, and right side isometric view of the container of FIG. 1 in an open configuration.

Referring now to FIG. 7, the container 100 is illustrated in an open position or configuration in which the lid 140 has been rotated via the hinge 180. Thus, it will be understood that the lid 140 is capable of being rotated about the hinge axis 182 to uncover the cavity 108. In some aspects, the lid 140 can rotate at least 270 degrees via the hinge 180, or at least 180 degrees via the hinge 180. As discussed above, the hinge 180 serves as a connection point between the shell 102 and the liner 104. In particular, the shell 102 forms one side of the hinge 180, e.g., the side of the hinge along the rear wall 114 of the base 110, and the liner 104 forms an opposite side of the hinge 180, which is visible in FIG. 7. Moreover, the liner 104 defines an innermost surface of the container 100 and an interior volume 206.

Specifically, the portion of the liner 104 in the base 110 is a cuboid or box-shaped container that is provided to nest within the cavity 108 of the shell 102 of the container 100 for storage, protection, and thermal insulation of contents, e.g., beverage containers, received in the interior volume 206. However, it is contemplated that the liner 104 can be formed in any suitable shape or combination of shapes, e.g., a cylinder. In some aspects, the liner 104 is a rigid container that is self-supporting and imparts structural integrity and form to the shell 102. In other examples, the liner 104 is provided as a soft and/or malleable material. In the non-limiting example illustrated in FIG. 7, a snug or tight fit is provided between the shell 102, the liner 104, and/or an insulation layer, which may be an airtight or waterproof/resistant fit. For example, a sealant or compound may be applied between the liner 104 and the shell 102 to prevent ingress or egress of air, water, gases, fluids, and the like.

In some embodiments, the liner 104 is coupled to the shell 102 by, for example, fasteners, an interference fit, glue, stitching, or welding (ultrasonic welding, RF welding, laser welding), among others. In some embodiments, the liner 104 is removably, permanently, or semi-permanently coupled to the shell 102. For example, the liner 104 can be removably coupled to the shell 102 by fasteners that can be unfastened. In some embodiments, an adhesive may be applied to the liner 104 and the shell 102 for permanent or semi-permanent attachment. In some examples, the liner 104 is coupled to the shell 102, such as, e.g., by stitching provided on the walls 112, 114, 116, 118 of the base 110 near the first end 128 thereof. In the non-limiting example illustrated in FIG. 7, the shell 102 is coupled to the liner 104 via welding, e.g., high frequency welding, ultrasonic welding, and/or laser welding, along the first closure 138 and the hinge 180. In some examples, the liner 104 and the shell 102 are configured to float when immersed in a body of water, thereby allowing the container 100 to buoyantly travel with or remain near a user engaged in a water activity and also preventing the container 100 from sinking. To accomplish such buoyancy, buoyant gases or materials may be provided between the liner 104 and the shell 102, or within the liner 104 and/or the shell 102, or coupled to the liner 104 and/or the shell 102.

Moreover, the liner 104 is constructed to be generally smooth, e.g., free of sharp corners or edges, although it is contemplated that the liner 104 includes one or more seams in some examples. Moreover, the liner 104 is configured to be coupled tightly to the shell 102 and to avoid tearing or ripping of the shell 102. In some examples, the liner 104 includes rigid portions or supports thereon, or a material that is substantially more rigid than the material of the shell 102, or a material that is substantially thicker than the material of the shell 102. Further, it is contemplated that a pull tab (not shown) may be coupled to the liner 104 to facilitate removal of the liner 104 from the shell 102. The liner 104 may be constructed from injection molded plastic, such as, e.g., polypropylene ("PP"), homopolymer PP, Copolymer PP, Random Copolymer, thermoplastics, and/or any other plastics or polyolefins, or combinations thereof.

With continued reference to FIG. 7, the base 110 of the container 100 includes an outer base layer 122 defined by the shell 102, an inner base layer 124 defined by the liner 104, and a base insulation layer 126 disposed therebetween (see FIG. 9). In some aspects, the outer base layer 122, inner base layer 124, and base insulation layer 126 (see FIG. 9) define planar walls and are open on one end, e.g., the top or first end 128. When the container 100 is assembled, the inner base layer 124, i.e., the liner 104, is received and secured within the base insulation layer 126, i.e., the shell 102, and the base insulation layer 126 (see FIG. 9) is received and secured therebetween. As discussed above, the shell 102 and the liner 104 are coupled to one another at the hinge 180, and it is contemplated that the shell 102 and the liner 104 may not be directly coupled to one another at any other location on the container 100 other than the hinge 180.

However, in the non-limiting example illustrated in FIG. 7, the outer base layer 122 and the inner base layer 124 are also coupled to one another along a portion of the first closure 138 that is coupled to the first end 128 of the base 110, i.e., a lower or first half 208A of the first closure 138. Put another way, a first half 208A of the first closure 138 extends around a periphery of the base 110 at the first end 128 thereof. In particular, the outer base layer 122 is coupled to an outer or first side 210A of the first half 208A of the first closure 138, and the base inner layer is coupled to an inner or second side 210B of the first half 208A of the first closure 138. In this way, a first joint 196A is formed between the shell 102 and the liner 104, which in turn secures the liner 104 to the container 100.

In some examples, the inner base layer 124 defines a seat 212 at the first end 128 of the container 100, and the seat 212 extends around an inner periphery of each of the front, rear, left, and right walls 112, 114, 116, 118 of the base 110 at the first end 128. In some aspects, the seat 212 defines a planar surface that is substantially parallel to the ZX plane (not shown), i.e., parallel to the z-axis 134 and the x-axis 136. Specifically, the seat 212 is formed atop the base insulation layer 126 (see FIG. 9) and below the first half 208A of the first closure 138. Thus, it will be understood that the first half 208A of the first closure 138 extends upward from the seat 212 in a direction that is parallel to the y-axis 132. In some aspects, the inner base layer 124 includes seat seams 214 along the peripheral edges of the seat 212, although it is contemplated that the inner base layer 124 may alternatively be constructed as a generally smooth, one-piece structure as discussed above. In some examples, the inner base layer 124 is secured to the other components of the base 110, e.g., the outer base layer 122, the base insulation layer 126 (see FIG. 9), and/or the first half 208A of the first closure, along one or more of the seat seams 214. Moreover, the seat 212 is configured to receive a corresponding structure of the lid 140 thereon when the lid 140 is in the closed position, as will be discussed below in greater detail.

Figure 8:
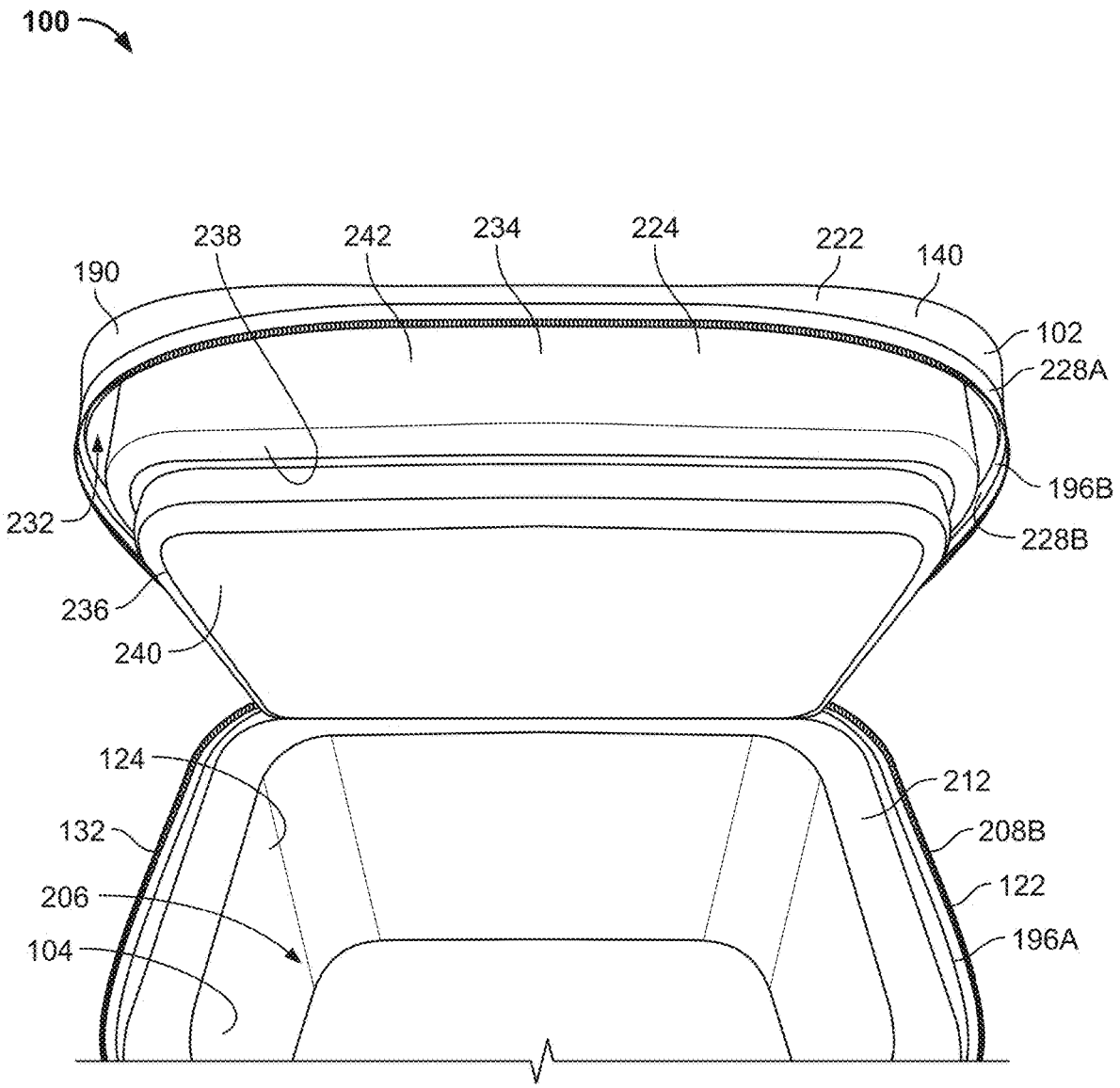
FIG. 8 is a front detail view of a lid of the container of FIG. 1.

Referring now to the non-limiting examples illustrated in FIGS. 7-8, the lid 140 is configured as a lid assembly that includes an outer lid layer 222 defined by the shell 102, e.g., the top wall 150 of the lid 140 and the first strip 190, an inner lid layer 224 defined by the liner 104, and one or more lid insulation layers 226 (see FIG. 9) disposed therebetween. In some aspects, the inner lid layer 224 is an integral one-piece component, or the inner lid layer 224 includes a plurality of liner elements that are coupled to one another via, e.g., adhering, stitching, and/or welding. Moreover, a snug or tight fit is provided between the outer lid layer 222, the inner lid layer 224, and/or and the lid insulation layer(s) 226 (see FIG. 9), which may be an airtight or waterproof/resistant fit. For example, a sealant or compound may be applied between the liner 104 and the shell 102 to prevent ingress or egress of air, water, gases, fluids, and the like. In addition, the outer lid layer 222 and the inner lid layer 224 are coupled to one another along the hinge 180 (see FIG. 3) and a portion of the first closure 138 that is coupled to the lid, i.e., an upper or second half 208B of the first closure 138. In particular, the outer lid layer 222 is coupled to an outer or first side 228A of the second half 208B of the first closure 138, and the inner lid layer 224 is coupled to an inner or second side 228B of the second half 208B of the first closure 138. In this way, a second joint 196B is formed between the shell 102 and the liner 104, which in turn secures the liner 104 to the container 100. In some aspects, the second half 208B of the first closure 138 extends around a periphery of the lid 140.

In some aspects, the inner lid layer 224 and the lid insulation layer(s) 226 (see FIG. 9) are coupled to an underside 232 of the lid 140 and define a first portion or cover 234 and a second portion or plug 236. The cover 234 is coupled to the underside 232 of the lid 140 and protrudes therefrom opposite the top wall 150, e.g., along the y-axis 132 toward the base 110 when the lid 140 is in the closed position (see FIG. 9). Relatedly the plug 236 protrudes from the cover 234 opposite the top wall 150, e.g., along the y-axis 132 toward the base 110 when the lid 140 is in the closed position (see FIG. 9). In some examples, the cover 234 and the plug 236 define substantially rectangular profiles that are similar to the profiles of the base 110 and the lid 140. Moreover, the cover 234 and the plug 236 are aligned with one another, e.g., concentric with one another and the top wall 150 of the lid 140, along the y-axis 132 when the lid 140 is in the closed position (see FIG. 9). Still further, the cover 234 has a smaller area than that of the top wall 150 (see FIG. 5) of the lid 140, and the plug 236 has a smaller area than the area of the cover 234.

Put another way, such that the lid insulation layers 226 define a stepped profile that corresponds to the shape of the inner base layer 124 and the seat 212. For example, the cover 234 defines a first step surface or rim 238 around the plug 236, the rim 238 defining a planar surface that is substantially parallel to the ZX plane (not shown) when the lid is in the closed position (see FIG. 9). Relatedly, the plug 236 defines a second step surface or first/bottom plug surface 240 that abuts the interior volume 206 of the base 110 when the lid 140 is in the closed position (see FIG. 9). The bottom plug surface 240 is also a substantially planar surface that is parallel to the ZX plane (not shown) when the lid is in the closed position (not shown), meaning that the bottom plug surface 240 is parallel with respect to the rim 238. In addition, the plug 236 defines a second or side plug surface 242 around the periphery thereof, and the side plug surface 242 is configured to contact sides of the inner base layer 124 that define the interior volume 206 when the lid 140 is in the closed position (see FIG. 9), as will be discussed below in greater detail.

Referring now to FIG. 9, a cross-sectional view is illustrated of the container 100 taken through line 9-9 in FIG. 2, and the lid 140 is in the closed position. As discussed above, the base 110 of the container 100 includes the outer base layer 122 defined by the shell 102, the inner base layer 124 defined by the liner 104, and the base insulation layer 126 that is disposed between the outer base layer 122 and the inner base layer 124. In a similar way, the lid 140 of the container 100 includes the outer lid layer 222 defined by the shell 102, the inner lid layer 224 defined by the liner 104, a first lid insulation layer 226A disposed between the outer lid layer 222 and the inner lid layer 224, and a second lid insulation layer 226B covered by the inner lid layer 224. When the container 100 is assembled, the insulation layers 126, 226 are injected between the outer layers 122, 222 and the inner layers 124, 224, although it is contemplated that other configurations are also possible. In some aspects, the insulation layers 126, 226 are placed or slipped between the outer layers 122, 222 and inner layers 124, 224 during the manufacturing process. For example, the inner layers 124, 224 are received and secured within outer layers 122, 222, and the insulation layers 126, 226 are received or slipped between the outer layers 122, 222 and the inner layers 124, 224.

In some examples, the insulation layers 126, 226 may be secured, e.g., fastened, adhered, welded, to the outer layers 122, 222 and/or the inner layers 124, 224 at one or more points, or the insulation layers 126, 226 are floating insulation layers which are not coupled to the outer layers 122, 222 and/or the inner layers 124, 224. In the non-limiting example illustrated in FIG. 9, the base insulation layer 126, the first lid insulation layer 226A, and the second lid insulation layer 226B are each shown as one-piece integral components, although it is contemplated that the insulation layers 126, 226 may alternatively be formed of multiple components. For example, the base insulation layer 126 may include side insulation pieces (not shown) that are secured to a bottom insulation piece (not shown) before the inner base layer 124 is overlaid thereon to form the interior volume 206. In some examples, the base insulation layer 126 is scored before being placed in between the outer and inner base layers 122, 124 to allow the base insulation layer 126 to be folded in the shape of the container 100. In addition, the insulation layers 126, 226 may be made of polyurethane, expanded polyurethane, open-cell or closed-cell foam, EVA foam, or any other known insulative material to enable the container 100 for ice retention over extended periods of time, such as, e.g., about 7 hours or more.

With continued reference to FIG. 9, and as discussed above, the liner 104 defines an interior volume 206 in which fluid, beverage containers, or other objects are contained, when the liner 104 is positioned within the cavity 108 of the shell 102. In some aspects, the interior volume 206 defines an internal height 244, an internal depth 246, and an internal width (not shown). In some aspects, the internal height 244 is between about 50% and about 75% of the external height 160, or between about 60% and about 70% of the external height 160, or about 65% of the external height 160 of the base 110. In some aspects, the internal depth 246 is between about 50% and about 100% of the external depth 162, or between about 60% and about 80% of the external depth 162, or about 75% of the external depth 162 of the base 110. In addition, the interior volume 206 has a volume that is between about 1 gallon (3.79 liters) and about 20 gallons (75.71 liters), or between about 1 gallon (3.79 liters) and about 5 gallons (18.93 liters), or between about 5 gallons (18.93 liters) and about 10 gallons (37.85 liters), or about 5 gallons (18.93 liters). In some aspects, the interior volume 206 is dimensioned so as to receive a particular quantity of beverage containers of a standard size in a vertical position and arranged in a grid-like fashion, i.e., m×n. For example, the interior volume 206 may be configured to receive twenty beverage containers arranged in a four-by-five grid, or twenty-four beverage containers arranged in a six-by-four grid, or thirty beverage containers arranged in a five-by-six grid, or thirty-two beverage containers arranged in an eight-by-four grid, or forty beverage containers arranged in an eight-by-six grid. However, different quantities of beverage containers may be received within the interior volume 206 and may be arranged differently, such as, e.g., stacked vertically atop one another and/or disposed in horizontal positions below the first closure 138 atop of each of the walls 112, 114, 116, 118 (see FIG. 1) of the base 110 such that the lid 140 can be rotated about the hinge axis 182 (see FIG. 7) to the closed position.

Still referring to FIG. 9, the lid inner layer 224 and the lid insulation layers 226 define the cover 234 and the plug 236 of the lid 140. In particular, the cover 234 is defined by the inner lid layer 224 and the first lid insulation layer 226A, and the plug 236 is defined by the inner lid layer 224 and the second lid insulation layer 226B. In some aspects, the lid inner layer 224 also defines a partition layer 248 disposed between the first lid insulation layer 226A and the second lid insulation layer 226B, although it is also contemplated that the lid insulation layers 226 may alternatively be in direct contact with one another.

In some examples, the lid 140 is configured to seal the interior volume 206 from a surrounding environment when the lid is in the closed position. To that end, when the lid 140 is actuated about the hinge axis 182 (see FIG. 3) so as to be arranged in the closed position, the rim 238 defined by the cover 234 contacts the seat 212 formed by the inner base layer 124 atop the base insulation layer 126, and the plug 236 is inserted at least partially into the interior volume 206. Put another way, plug 236 extends past the seat 212 along the y-axis 132 to abut the interior volume 206 when the lid is arranged in the closed position. Further, as illustrated in FIG. 9, the side plug surface 242 of the plug 236 contacts the sides of the inner base layer 124 that define the interior volume 206 when the lid 140 is in the closed position, thereby sealing the interior volume 206 from a surrounding environment.

In some examples, the plug 236 forms an interference fit with the liner 104, e.g., the sides of the inner base layer 124 that define the interior volume 206 when the lid 140 is in the closed position, which in turn seals the interior volume 206 from the environment. In this way, the cover 234 and the plug 236 of the lid 140 may create a generally water- and/or air-tight seal between the lid 140 and the base 110 when the lid 140 is in the closed position. That is, the interference fit defined by the liner 104 and the plug 236 helps prevent the container 100 from leaking any fluids from within and allows for a slower rate of heat transfer between the interior volume 206 and a surrounding or ambient environment of the container 100. In some examples, the lid 140 is configured to provide an air-tight and water-tight seal between the ambient environment and the interior volume 206, such that the container 100 is configured to be water-resistant and/or waterproof. In some examples, the seal may not be a completely air-tight or water-tight.

Correspondingly, it will be understood that in addition to the first closure 138, the shape(s) of the cover 234 and the plug 236 provide the seal between the ambient environment and the interior volume 206. In particular, and as illustrated in FIG. 9, the cover 234 can define a height 250, a depth 252, and a width (not shown), and the plug 236 can also define a height 254, a depth 256, and a width (not shown). Each of the heights 250, 254, depths, 252, 256, and widths (not shown) are measured along the y-axis 132, the z-axis 134, and the x-axis 136, respectively. In some aspects, the height 250, the depth 252, and/or the width (not shown) of the cover 234 are greater than the height 254, the depth 256, and/or the width (not shown) of the plug 236, respectively. For example, the height 254 of the plug 236 may be between about 25% and about 75% of the height 250 of the cover 234, or between about 40% and about 50% of the height 250 of the cover 234, or about 45% of the height 250 of the cover 234. Further, the depth 256 of the plug 236 may be between about 50% and about 100% of the depth 252 of the cover 234, or between about 75% and about 90% of the depth 252 of the cover 234, or about 85% of the depth 252 of the cover 234.

In some examples, the depth 252 of the cover 234 is less than the external depth 162 of the container 100 and greater than the internal depth 246 of the interior volume 206. In this way, a gap 258 is formed between the cover 234 and the front, rear, left, and right walls 142, 144, 146, 148 (see FIG. 5) of the lid 140. Specifically, the depth 252 of the cover 234 may be between about 75% and about 100% of the external depth 162, or between about 85% and about 95% of the external depth 162, or about 92% of the external depth 162 of the container 100. In some examples, the depth 256 and/or the width (not shown) of the plug 236 are approximately equal to or larger than the internal depth 246 and the internal width (not shown), respectively, of the interior volume 206. Thus, when the lid is in the closed position and the plug 236 is partially inserted into the interior volume 206, larger profile of the plug 236 creates an interference fit with the liner 104, thereby creating the seal between the interior volume 206 and the ambient environment. In some aspects, the depth 256 of the plug 236 may be between about 90% and about 110% of the internal depth 246, or between about 100% and about 105% of the internal depth 246, or about 100% of the internal depth 246 of the interior volume 206.

Figure 10:
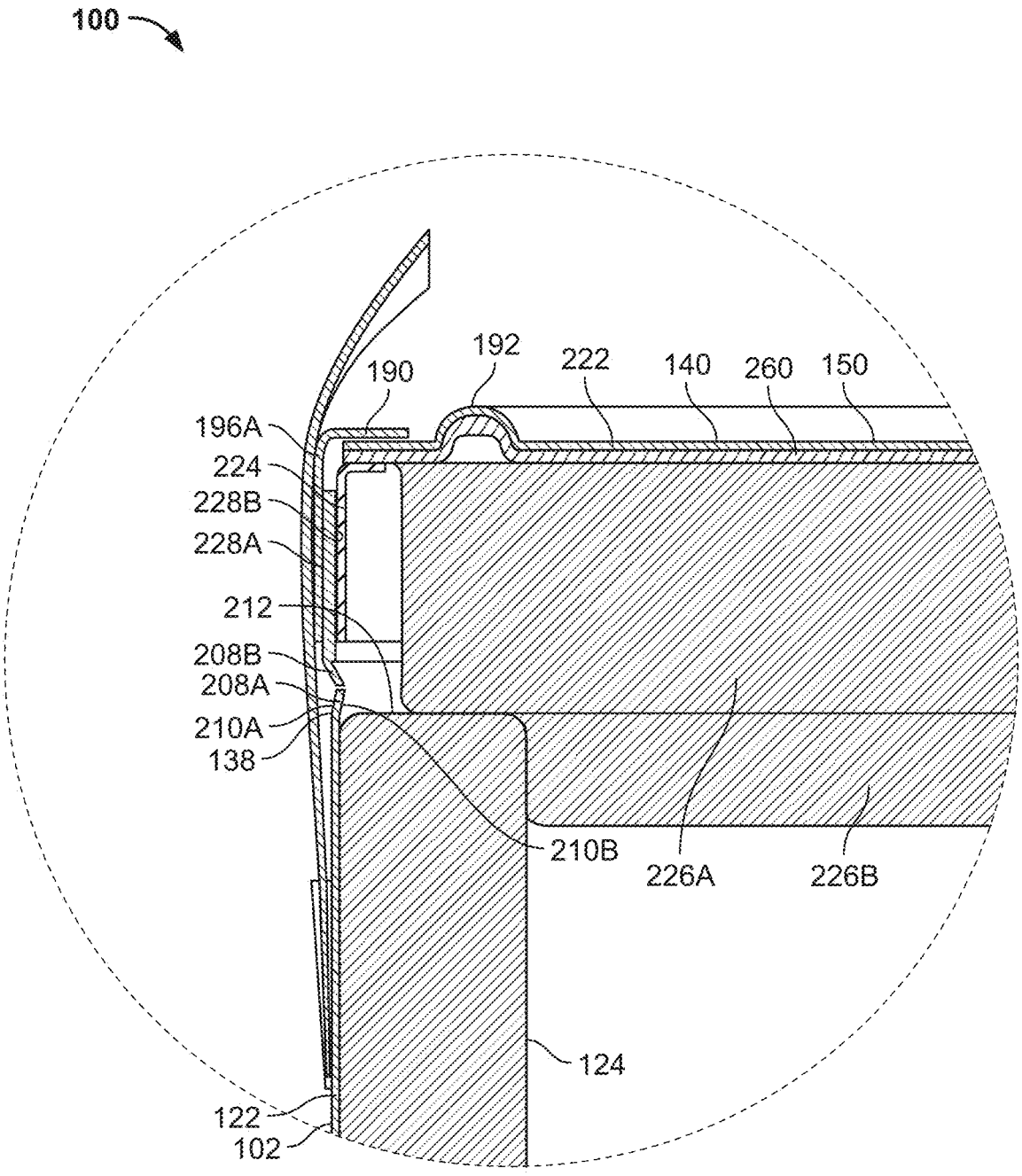
FIG. 10 is a is a detail view of a top corner of the container of FIG. 9.

Referring now to FIG. 10, a detail, cross-sectional view is illustrated of an upper corner, e.g., an upper left-hand corner, of the container 100. As discussed above, the shell 102 and the liner 104 are coupled to one another at the hinge 180 (see FIG. 3) and the first closure 138. In particular, the outer and inner base layers 122, 124 are coupled to the first half 208A of the first closure 138, and the outer and inner lid layers 222, 224 are coupled to the upper or second half 208B of the first closure 138. Further, the first strip 190 of material couples the top wall 150 of the lid 140 to the second half 208B of the first closure 138, thereby forming the first joint 196A. In addition, the top wall 150 includes the first ridge 192 that is formed integrally therewith.

In some aspects, the lid 140 further includes a top or first support layer 260 that is coupled to a bottom side of the top wall 150, i.e., disposed between the top wall 150 and the first lid insulation layer 226A. The first support layer 260 is configured to reinforce the top wall 150 and increase the durability and/or rigidity of the shell 102. For example, the first support layer 260 is used to form the first ridge 192 and the logo 198 (see FIG. 5) in the top wall 150, meaning that the first ridge 192 and the logo 198 (see FIG. 5) are also formed in the first support layer 260. Moreover, it is contemplated that the first support layer 260 can be constructed from a variety of different materials with different material properties. For example, the first support layer 260 may be more or less rigid, elastic, strong, ductile, hard, brittle, tough, resilient, and/or stiff than the outer lid layer 222, i.e., the shell 102. It is contemplated that the first support layer 260 may be constructed from an EVA-Solid-Sponge ("ESS") material, an EVA foam, polyurethane, polyether, an olefin block copolymer, a thermoplastic material (e.g., a thermoplastic polyurethane, a thermoplastic elastomer, a thermoplastic polyolefin, etc.), and/or a supercritical foam. In some examples, the first support layer 260 is formed, for example, using of an expansion press, an injection machine, a pellet expansion process, a cold foaming process, a compression molding technique, die cutting, or any combination thereof.

Figure 11:
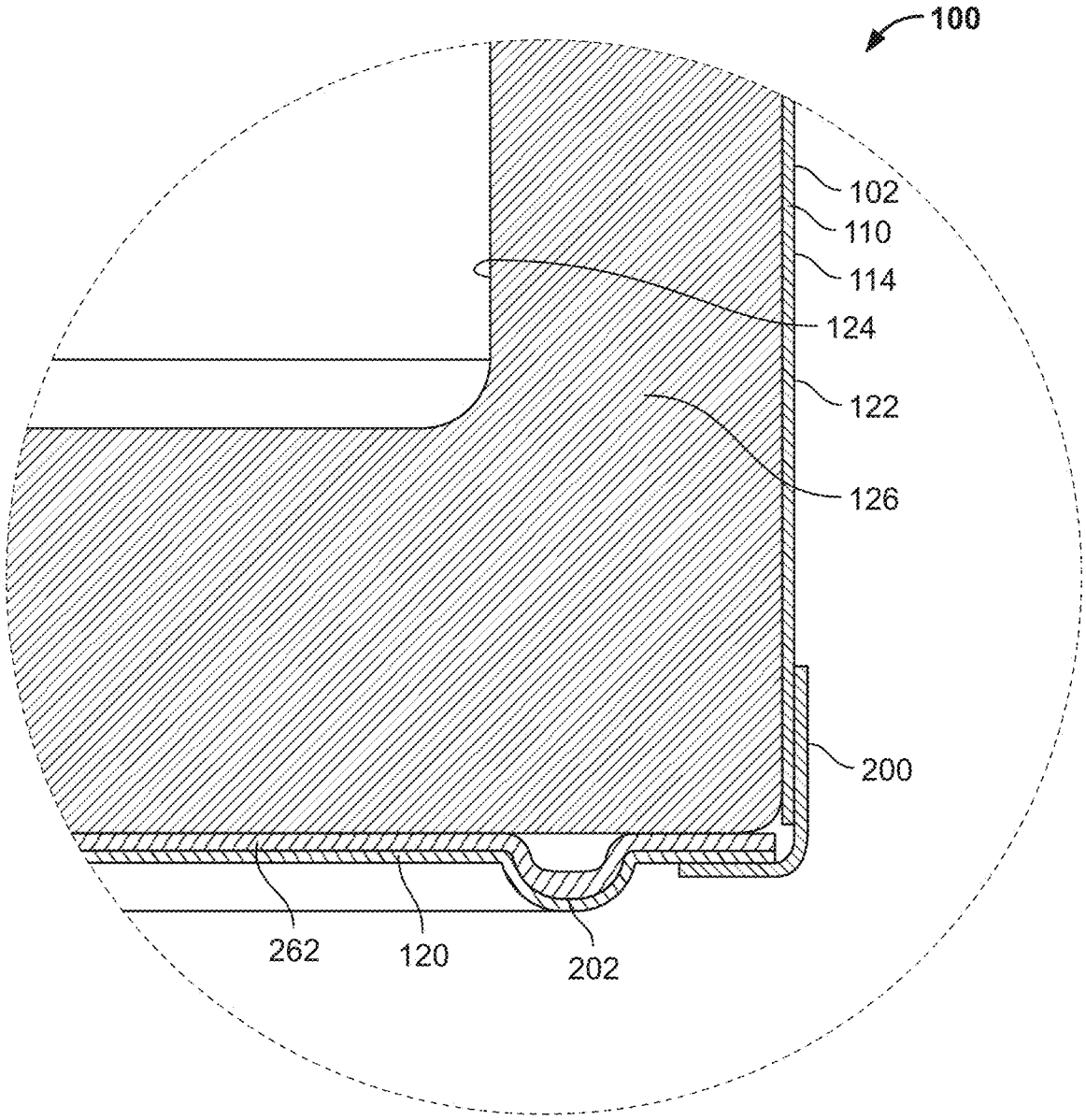
FIG. 11 is a detail view of a bottom corner of the container of FIG. 9.

Referring now to FIG. 11, a detail cross-sectional view is illustrated of a lower corner, e.g., a lower right-hand corner, of the container 100. As discussed above, the second strip 200 of material extends around the outer periphery of the bottom wall 120 and is configured as a corner joint to couple the front, rear, left, and right walls 112, 114, 116, 118 of the base 110 to the bottom wall 120 of the base 110. Further, the bottom wall 120 includes the second ridge 202 and/or the logo 204 (see FIG. 6) that are formed integrally therewith. In some aspects, the base 110 further includes a bottom or second support layer 262 that is coupled to a top side of the bottom wall 120, i.e., disposed between the bottom wall 120 and the base insulation layer 126. The second support layer 262 is configured to reinforce the bottom wall 120 and increase the durability and/or rigidity of the shell 102. For example, the second support layer 262 is used to form the second ridge 202 and the logo 204 (see FIG. 6) in the bottom wall 120, meaning that the second ridge 202 and the logo 204 (see FIG. 6) are also formed in the second support layer 262. Moreover, it is contemplated that the second support layer 262 can be constructed from a variety of different materials with different material properties. For example, the second support layer 262 may be more or less rigid, elastic, strong, ductile, hard, brittle, tough, resilient, and/or stiff than the outer base layer 122, i.e., the shell 102. It is contemplated that the second support layer 262 may be constructed from an EVA-Solid-Sponge ("ESS") material, an EVA foam, polyurethane, polyether, an olefin block copolymer, a thermoplastic material (e.g., a thermoplastic polyurethane, a thermoplastic elastomer, a thermoplastic polyolefin, etc.), and/or a supercritical foam. In some examples, the second support layer 262 is formed, for example, using of an expansion press, an injection machine, a pellet expansion process, a cold foaming process, a compression molding technique, die cutting, or any combination thereof.

Figure 12:
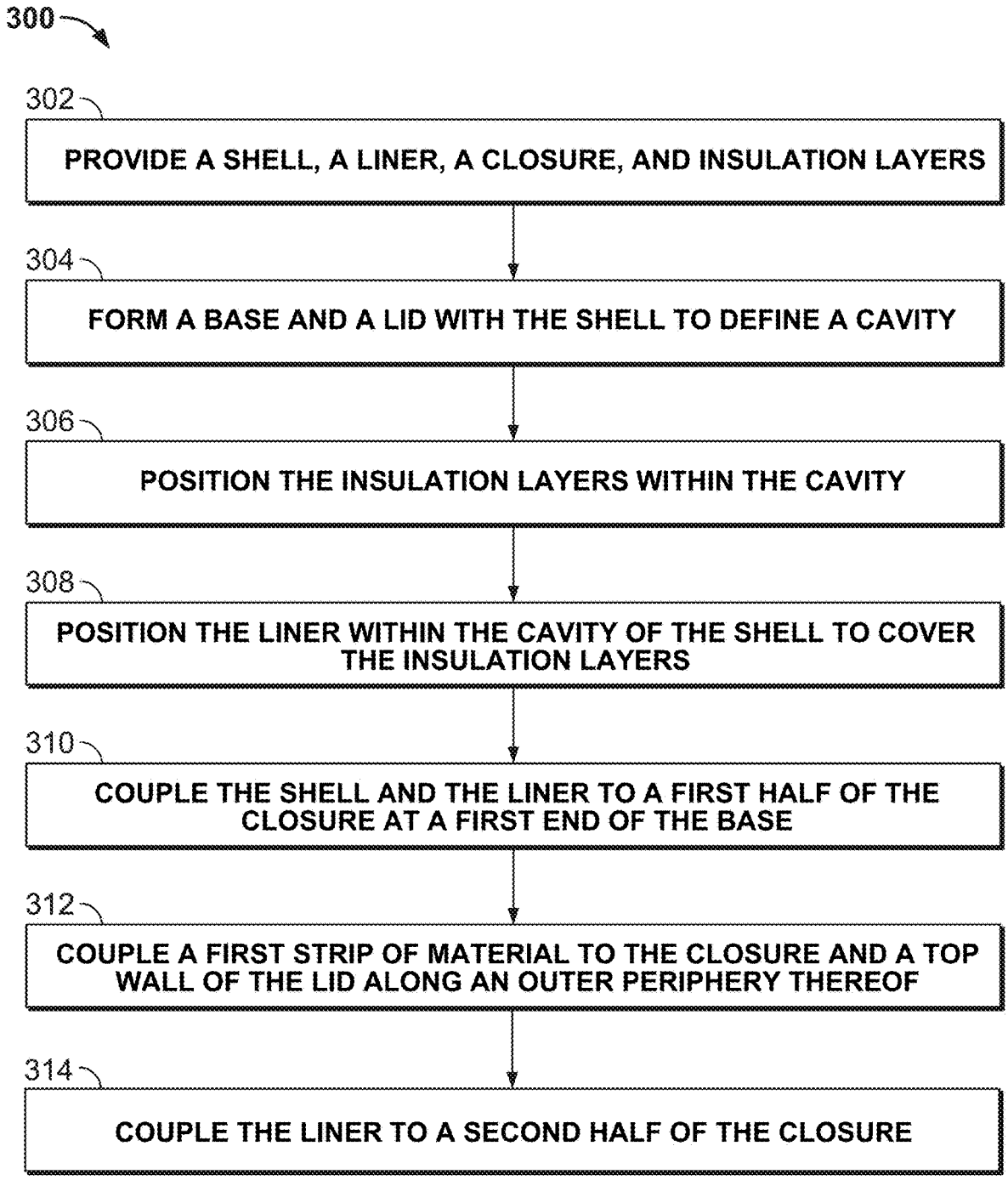
FIG. 12 is a flowchart representation of an example method of manufacturing the container of FIG. 1.

FIG. 12 depicts a flowchart illustrating a method 300 for assembling the container 100. While the example process is described with reference to the flowchart illustrated in FIG. 12, various other methods of assembling the container 100 may alternatively be used. For example, the order of execution of the blocks may be rearranged, changed, eliminated, and/or combined to perform the method 300. Step 302 of the method 300 includes providing the shell 102, the liner 104, the insulation layers 126, 226, and the first closure 138. In some aspects, providing the shell 102, the liner 104, and the insulation layers 126, 226 includes forming or cutting sheets of material(s) to size. For example, multiple rectangular insulation layers are cut from a large sheet of insulative material, e.g., open- or closed-cell foam, or each of the insulation layers 126, 226 are formed as integral one-piece sheets.

Step 304 of the method 300 includes forming the base 110 and the lid 140 to define the cavity 108. For example, opposing sides of the shell 102, e.g., the outer base layer 122, the first strip 190 of material, the second strip 200 of material, and/or the outer lid layer 222, are coupled to one another to one another along a seam, e.g., the seam 184, to form the rectangular shape of the container 100, the base 110, and/or the lid 140. In some aspects, providing the shell 102 also includes forming, e.g., molding, stamping, casting, etc., the bottom wall 120 and/or the top wall 150 to include the ridges 192, 202 and/or the logos 198, 204, respectively, thereon. In some examples, step 304 further includes coupling the second strip 200 of material to the shell 102, e.g., the outer base layer 122, and the bottom wall 120 of the base 110 along an outer periphery of the bottom wall 120. In this way, the second strip 200 forms the second joint 196B between the front, rear, left, and right walls 112, 114, 116, 118 of the base 110 and the bottom wall 120 of the base 110.

Step 306 of the method 300 includes positioning or slipping the insulation layers 126, 226 within the cavity 108 of the shell 102, and step 308 of the method 300 includes positioning the liner 104 within the cavity 108 of the shell 102 to cover the insulation layers 126, 226. In particular, the base insulation layer 126 is placed or slipped into the cavity 108 before the inner base layer 124 is inserted into the cavity 108, meaning that the base insulation layer 126 is positioned in between the outer and inner base layers 122, 124. For example, the base insulation layer 126 is formed as a one-piece sheet which is scored to conform to the shape of the outer base layer 122, or the base insulation layer 126 is provided as an assembly with multiple insulation sheets that correspond to each of the walls 112, 114, 116, 118, 120 of the base 110. In some aspects, positioning the liner 104 within the cavity 108 further includes forming the seat 212 atop the base insulation layer 126 proximate to the first end 128 of the base 110. Thus, in some examples, individual sheets (not shown) of the liner 104 are positioned to cover the insulation layers 126, 226 and define the interior of the container 100, e.g., the seat 212, the cover 234, and the plug 236. Further, the lid insulation layers 226 are positioned in between the outer and inner lid layers 222, 224, meaning that the lid insulation layers 226 are positioned proximate to the underside 232 of the lid 140. In some examples, step 306 further includes positioning the first and second support layers 260, 262 proximate the top wall 150 and the bottom wall 120, respectively.

Step 310 of the method 300 includes coupling, e.g., welding, the outer and inner base layers 122, 124 to the first closure 138 to seal the base insulation layer 126 from the ambient environment and define the interior volume 206. For example, the outer and inner base layers 122, 124 are coupled to opposing sides of the first half 208A of the first closure 138 at the first end 128 of the base 110. In some aspects, step 310 further includes welding individual sheets of the inner base layer 124 together along one or more seams, e.g., the seat seams 214, to form the seat 212 atop the base insulation layer 126 proximate to the first end 128 of the base 110. Accordingly, the base insulation layer 126 is secured between the outer base layer 122 and the inner base layer 124, although it is contemplated that the base insulation layer 126 may be a floating insulation layer that is not coupled to the outer and/or inner base layers 122, 124.

Step 312 of the method 300 includes coupling, e.g., integrally molding, welding, adhering, etc., the first strip 190 of material to the first closure 138 and the top wall 150 of the lid 140 along an outer periphery of the lid 140. In particular, the first strip 190 is coupled to a first side 210A of the second half 208B of the first closure 138 to form the front, rear, right, and left walls 142, 144, 146, 148 of the lid 140. Thus, the first strip 190 forms the first joint 196A between the top wall 150 of the lid 140 and the first closure 138. Step 314 of the method 300 includes coupling the liner 104, e.g., the inner lid layer 224, to the first closure 138 to seal the lid insulation layers 226 from the ambient environment, and define the cover 234 and the plug 236. In particular, the inner lid layer 224 is coupled to the second side 228B of the second half 208B of the first closure 138. In some aspects, the lid insulation layers 226 are not directly coupled to the underside 232 of the lid 140, instead being covered by the inner lid layer 224 which in turn is coupled to the underside 232 of the lid 140. For example, the first lid insulation layer 226A is positioned between the underside 232 of the lid 140 and one side the partition layer 248 of the inner lid layer 224, and the second lid insulation layer 226A is positioned on the other side of the partition layer 248 to abut the interior volume 206 of the container 100. Thus, in some aspects, the inner lid layer 224 includes multiple components that are coupled, e.g., welded, to one another to cover the lid insulation layers 226, i.e., to define the cover 234 and the plug 236.

Although various aspects are herein disclosed in the context of certain preferred embodiments, implementations, and examples, it will be understood by those skilled in the art that the present invention extends beyond the specifically disclosed embodiments to other alternative embodiments and/or uses of the inventive aspects and obvious modifications and equivalents thereof. In addition, while a number of variations of the aspects have been noted, other modifications, which are within their scope, will be readily apparent to those of skill in the art based upon this disclosure. It should be also understood that the scope of this disclosure includes the various combinations or sub-combinations of the specific features and aspects of the embodiments disclosed herein, such that the various features, modes of implementation and operation, and aspects of the disclosed subject matter may be combined with or substituted for one another. Thus, it is intended that the scope of the present invention herein disclosed should not be limited by the particular disclosed embodiments or implementations described above, but should be determined only by a fair reading of the claims.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. A container, comprising:

a base including an outer base layer, an inner base layer, and a base insulation layer, the inner base layer defining an interior volume of the container;

a moveable lid coupled to the base at a first end thereof, the moveable lid including an outer lid layer, a first insulation layer, a second insulation layer, and an inner lid layer covering the first insulation layer and the second insulation layer; and a seat formed by the inner base layer at the first end of the base, wherein the first insulation layer and the inner lid layer define a rim that contacts the seat when the moveable lid is in a closed position, and wherein the second insulation layer and the inner lid layer define a plug that forms an interference fit with the inner base layer to seal the interior volume when the moveable lid is in the closed position.

2. The container of claim 1 further comprising a waterproof closure extending around a periphery of the first end of the base.

3. The container of claim 2, wherein the outer base layer and the inner base layer are coupled to a first half of the waterproof closure, and wherein the outer lid layer and the inner lid layer are coupled to a second half of the waterproof closure.

4. The container of claim 1, wherein the outer base layer is made of a synthetic fabric.

5. The container of claim 1, wherein the inner base layer extends atop the base insulation layer to define the seat, and wherein the seat defines a planar surface.

6. The container of claim 1, wherein the plug extends past the seat to abut the interior volume when the moveable lid is in the closed position.

7. The container of claim 1, wherein the plug defines a first plug surface that abuts the interior volume when the moveable lid is in the closed position, and wherein the plug further defines a second plug surface around a periphery thereof.

8. The container of claim 7, wherein the second plug surface is configured to contact sides of the inner base layer when the moveable lid is in the closed position.

9. A container, comprising:

a base including an outer base layer, an inner base layer, and a base insulation layer; and a moveable lid coupled to the base at a first end thereof, the moveable lid including a cover, a plug, and an inner lid layer covering the cover and the plug; and a y-axis extending in a direction that is parallel to the outer base layer, wherein the plug protrudes from the cover, and wherein the cover defines a first height measured along the y-axis that is greater than a second height of the plug measured along the y-axis.

10. The container of claim 9, wherein the second height of the plug is between about 25% and about 75% of the first height of the cover.

11. The container of claim 9, wherein the cover defines a first depth measured perpendicular to the y-axis that is greater than a second depth of the plug measured perpendicular to the y-axis.

12. The container of claim 11, wherein the second depth of the plug is between about 50% and 100% of the first depth of the cover.

13. The container of claim 10 further comprising one or more straps coupled to one or more patches that are coupled to the outer base layer.

14. The container of claim 13, wherein the one or more patches are covered by flaps formed in the outer base layer.

15. The container of claim 9, wherein the plug forms an interference fit with the inner base layer to seal an interior volume of the container defined by the inner base layer when the moveable lid is in a closed position.

16. A method of manufacturing a container, the method comprising:

providing a shell, a liner, a closure, and one or more insulation layers;

forming a base and a lid with the shell to define a cavity;

positioning the one or more insulation layers within the cavity;

positioning the liner within the cavity to cover the one or more insulation layers;

coupling the shell and the liner to a first half of the closure at a first end of the base;

coupling a first strip of material to a second half of the closure and a top wall of the lid along a first outer periphery of the lid; and coupling the liner to the second half of the closure.

17. The method of claim 16, wherein the shell includes an outer base layer and an outer lid layer, and wherein the liner includes an inner base layer and an inner lid layer.

18. The method of claim 17, wherein the inner lid layer is coupled to an underside of the lid to cover a first insulation layer and a second insulation layer.

19. The method of claim 16, wherein positioning the liner within the cavity includes forming a seat with the liner atop a base insulation layer at the first end of the base.

20. The method of claim 16 further comprising molding at least one of the top wall and a bottom wall of the container to include a logo thereon.

* * * * *